US010279370B2

(12) United States Patent
Arvinte et al.

(10) Patent No.: US 10,279,370 B2
(45) Date of Patent: May 7, 2019

(54) PAINT ROLLER FRAME

(71) Applicant: A. RICHARD TOOLS CO./OUTILS A. RICHARD CO., Berthierville (CA)

(72) Inventors: Roméo Arvinte, Laval-des-Rapides (CA); François Panfili, Berthierville (CA)

(73) Assignee: A. RICHARD TOOLS CO./OUTILS A. RICHARD CO., Berthierville, Quebec (CA)

( * ) Notice: Subject to any disclaimer, the term of this patent is extended or adjusted under 35 U.S.C. 154(b) by 0 days.

(21) Appl. No.: 15/588,361

(22) Filed: May 5, 2017

(65) Prior Publication Data

US 2018/0304300 A1 Oct. 25, 2018

Related U.S. Application Data

(63) Continuation-in-part of application No. 29/601,434, filed on Apr. 21, 2017, now Pat. No. Des. 814,801.

(51) Int. Cl.
*B05C 17/02* (2006.01)

(52) U.S. Cl.
CPC ..... *B05C 17/022* (2013.01); *B05C 17/0217* (2013.01)

(58) Field of Classification Search
CPC .... B05C 17/02; B05C 17/022; B05C 17/0217
See application file for complete search history.

(56) References Cited

U.S. PATENT DOCUMENTS

| | | | | |
|---|---|---|---|---|
| 3,593,361 | A * | 7/1971 | Welt | B05C 17/0217 15/230.11 |
| 4,077,082 | A | 3/1978 | Roe et al. | |
| D258,043 | S | 1/1981 | Gregoire | |
| D263,277 | S | 3/1982 | Gregoire | |
| 4,868,946 | A * | 9/1989 | Marino | B05C 17/0217 15/230.11 |
| D320,888 | S | 10/1991 | Parizek | |
| 5,921,905 | A * | 7/1999 | Newman, Jr. | B05C 17/0217 492/13 |
| D414,395 | S | 9/1999 | Panfili | |
| D431,993 | S | 10/2000 | Panfili et al. | |
| 6,141,821 | A | 11/2000 | Chin | |
| D435,408 | S | 12/2000 | Panfili et al. | |
| D459,587 | S | 7/2002 | Newman et al. | |
| D463,639 | S | 9/2002 | Panfili et al. | |
| 6,519,800 | B2 * | 2/2003 | Newman | B05C 17/0217 15/152 |
| D474,389 | S | 5/2003 | Panfili et al. | |
| 6,629,331 | B2 | 10/2003 | Panfili et al. | |
| 6,719,620 | B1 | 4/2004 | Panfili et al. | |
| 6,726,868 | B1 | 4/2004 | Panfili et al. | |

(Continued)

*Primary Examiner* — Anita M King
(74) *Attorney, Agent, or Firm* — Merchant & Gould P.C.

(57) ABSTRACT

A roller frame is for use with a roller. The roller frame includes a base component, and first and second supporting components operatively projecting from the base component. Each supporting component has a mounting cap for receiving a corresponding distal end of the roller. The first and second supporting components are angularly adjustable with respect to the base component via a tightening assembly for allowing the roller to be selectively positioned at different angles with respect to the base component of the roller frame.

18 Claims, 22 Drawing Sheets

(56) References Cited

U.S. PATENT DOCUMENTS 6,742,215 B2 6/2004 Panfili et al.
6,775,912 B2 8/2004 Panfili et al.
D511,045 S 11/2005 Donaghue
7,043,793 B2 * 5/2006 Lu ..... B05C 17/0217 15/230.11
D541,998 S 5/2007 Panfili et al.
D555,361 S 11/2007 Arvinte
D555,362 S 11/2007 Arvinte
D555,363 S 11/2007 Arvinte
D567,053 S 4/2008 Panfili
7,384,328 B2 6/2008 Panfili
D573,863 S 7/2008 Arvinte et al.
D580,731 S 11/2008 Arvinte et al.
D583,521 S 12/2008 Arvinte et al.
D584,059 S 1/2009 Arvinte et al.
D584,870 S 1/2009 Arvinte et al.
D584,871 S 1/2009 Arvinte et al.
D586,515 S 2/2009 Arvinte et al.
D592,822 S 5/2009 Boucher et al.
D612,120 S 3/2010 Panfili et al.
D616,650 S 6/2010 Saadian
D622,063 S 8/2010 Isaac
7,784,142 B2 * 8/2010 Scott, Sr. ..... B05C 17/0217 15/230.11
D623,918 S 9/2010 Arvinte et al.
D630,856 S 1/2011 Arvinte et al.
D634,549 S 3/2011 Arvinte et al.
D637,819 S 5/2011 Arvinte et al.
D638,223 S 5/2011 Arvinte et al.
7,963,418 B2 6/2011 Arvinte et al.
D644,905 S 9/2011 Arvinte et al.
D645,627 S 9/2011 Arvinte et al.
D649,862 S 12/2011 Arvinte et al.
D652,283 S 1/2012 Arvinte et al.
D656,808 S 4/2012 Arvinte et al.
D659,503 S 5/2012 Arvinte et al.
D665,548 S 8/2012 Arvinte et al.
8,256,638 B2 9/2012 Arvinte et al.
D675,391 S 1/2013 Arvinte et al.
D681,343 S 5/2013 Arvinte et al.
D696,826 S 12/2013 Seehoff et al.
D697,955 S 1/2014 Arvinte
8,628,381 B2 1/2014 Arvinte et al.
D700,784 S 3/2014 Arvinte et al.
8,671,501 B2 * 3/2014 Buckel, Jr. ..... B05C 17/0217 15/230.11
D710,199 S 8/2014 Arvinte et al.
D712,156 S 9/2014 Arvinte et al.
D712,227 S 9/2014 Arvinte et al.
D712,610 S 9/2014 Arvinte et al.
8,856,995 B2 10/2014 Arvinte et al.
D720,592 S 1/2015 Arvinte
D729,484 S 5/2015 Arvinte et al.
D738,057 S 9/2015 Arvinte et al.
D740,510 S 10/2015 Arvinte et al.
D742,199 S 11/2015 Arvinte et al.
D742,610 S 11/2015 Arvinte et al.
D743,701 S 11/2015 Arvinte et al.
D744,759 S 12/2015 Arvinte et al.
D754,974 S 5/2016 Arvinte et al.
D756,049 S 5/2016 Arvinte et al.
D756,583 S 5/2016 Arvinte et al.
9,358,665 B2 6/2016 Talbot et al.
D766,199 S 9/2016 Arvinte
D785,889 S 5/2017 Arvinte et al.
D800,455 S 10/2017 Ferris
D814,801 S * 4/2018 Arvinte ..... D4/122
2004/0168276 A1 9/2004 Lye
2005/0091777 A1 * 5/2005 Lu ..... B05C 17/0217 15/230.11
2007/0017050 A1 1/2007 Lye
2008/0276400 A1 11/2008 Graham et al.

* cited by examiner

PAINT ROLLER FRAME

This application is a Continuation-in-Part of U.S. Design Patent Application No. 29/601,434, filed 21 Apr. 2017, and which application is incorporated herein by reference. To the extent appropriate, a claim of priority is made to the above disclosed application.

FIELD OF THE INVENTION

The present invention relates to a roller frame, hereinafter referred to also as a "paint roller frame". More particularly, in accordance with a preferred intended use, the present invention relates to a paint roller frame, such as the ones used with paint rollers and the like, for spreading a liquid-type substance (ex. paint, varnish, etc.) over a given work surface, and also relates to corresponding methods of manufacturing, assembly and use associated thereto.

BACKGROUND OF THE INVENTION

Known in the art are various tools used for painting applications and other related tasks, such as for applying varnishes, and other liquid-type substances, on given work surfaces, whether it be walls, floors, ceilings, rooftops and/or other surfaces.

Over the years, the Assignee of the present application has developed several painting tools, sanding tools, renovation tools and the like, examples of which are described in the following US patents and industrial designs: U.S. Pat. Nos. 6,629,331; 6,719,620; 6,726,868; 6,742,215; 6,775,912; 7,384,328; 7,963,418; 8,256,638; 8,628,381; 8,856,995; 9,358,665; D258,043; D263,277; D414,395; D431,993; D435,408; D463,639; D474,389; D541,998; D555,361; D555,362; D555,363; D567,053; D573,863; D580,731; D583,521; D584,059; D584,870; D584,871; D586,515; D592,822; D612,120; D623,918; D630,856; D634,549, D637,819; D638,223, D644,905; D645,627; D649, 862; D652,283; D656,808; D659,503; D665,548; D675,391; D681,343, D697, 955; D700,784; D710,199; D712,156; D712,227; D712,610; D720,592; D729,484; D738,057; D740,510, D742,199; D742,610; D743,701; D744,759; D754,974; D756,049; D756,583; D766,199; D785,889; the contents of which are entirely and/or selectively incorporated herein by reference.

Despite these various improvements over the years, there is always a need to continue innovating and finding better and/or different ways of painting and/or working with corresponding paint rollers, for example, in a more efficient, more precise, more accurate, more reliable, more adjustable, more versatile, more adaptable, more ergonomic and/or more desirable manner.

Indeed, it would be particularly advantageous to provide a paint roller frame capable of being adjustable with respect to a base component thereof, in order to selectively choose an optimal and/or preferred operating angle of painting, depending on the particular circumstances, intended results, and/or various other considerations, and factors, etc.

Thus, it would be particularly useful to be able to provide an improved roller frame which, by virtue of its design and components, would be able to overcome or at the very least minimize some of known drawbacks associated with conventional paint roller frames, for example.

SUMMARY OF THE INVENTION

An object of the present invention is to provide a roller frame which, by virtue of its design and components, is intended to satisfy the above-mentioned need, and which thus aims to offer an improvement over other related paint roller frames and/or painting methods known in the prior art.

In accordance with the present invention, the above object is achieved, as will be easily understood from the present description, with an adjustable roller frame such as the one briefly described herein and/or such as the one(s) exemplified in the accompanying drawings.

According to one aspect of the present invention, there is provided a roller frame for supporting a roller, the roller frame comprising:

a base component; and first and second supporting components operatively projecting from the base component, each supporting component having a mounting cap for receiving a corresponding distal end of the roller, the first and second supporting components being angularly adjustable with respect to the base component via a tightening assembly for allowing the roller to be selectively positioned at different angles with respect to the base component of the roller frame.

According to another aspect of the present invention, there is also provided a method of manufacturing the above-mentioned roller frame.

According to yet another aspect of the present invention, there is also provided a method of assembling the above-mentioned roller frame.

According to yet another aspect of the present invention, there is also provided a method of using (ex. operating, etc.) the above-mentioned roller frame.

According to yet another aspect of the present invention, there is also provided a method of securing/mounting the above-mentioned roller frame onto a complementary accessory, such as an extension pole, for example.

According to yet another aspect of the present invention, there is also provided a kit with components for assembling the above-mentioned roller frame.

According to yet another aspect of the present invention, there is also provided a set of components for interchanging with components of the above-mentioned kit.

According to yet another aspect of the present invention, there is also provided a method of assembling components of the above-mentioned kit and/or set.

According to yet another aspect of the present invention, there is also provided a method of doing business with the above-mentioned roller frame, associated complementary accessory, kit, set and/or method(s).

The objects, advantages, and other features of the present invention will become more apparent upon reading of the following non-restrictive description of preferred embodiments thereof, given for the purpose of exemplification only, with reference to the accompanying drawings.

DETAILED DESCRIPTION OF PREFERRED EMBODIMENTS OF THE INVENTION

Figure 1:
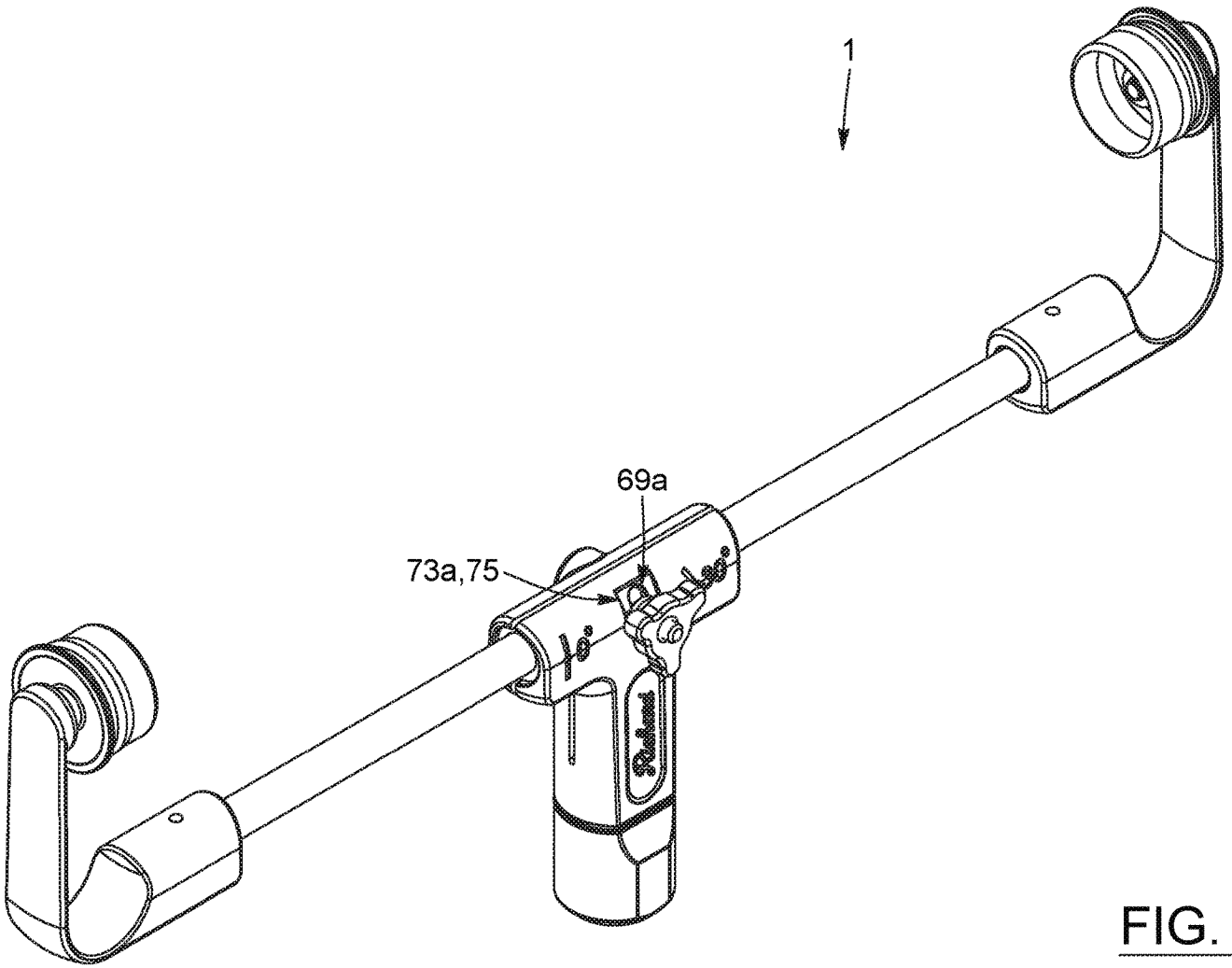
FIG. 1 is front perspective view of a roller frame according to a possible embodiment of the present invention, the roller frame being shown in a "straightened" configuration (i.e. with an operating angle of about 0° with respect to a longitudinal axis of the base component).
Figure 2:
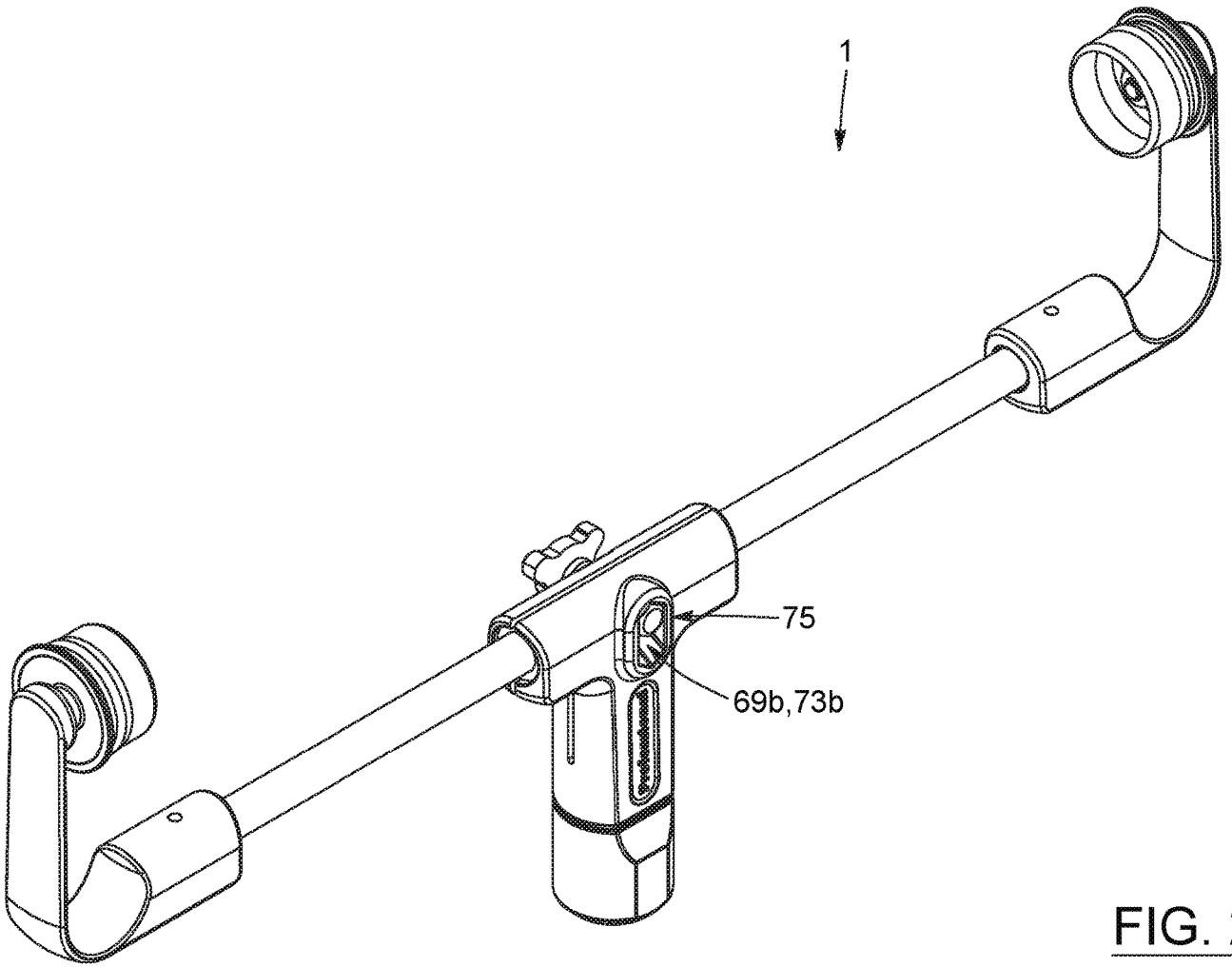
FIG. 2 is a rear perspective view of what is shown in FIG. 1.
Figure 3:
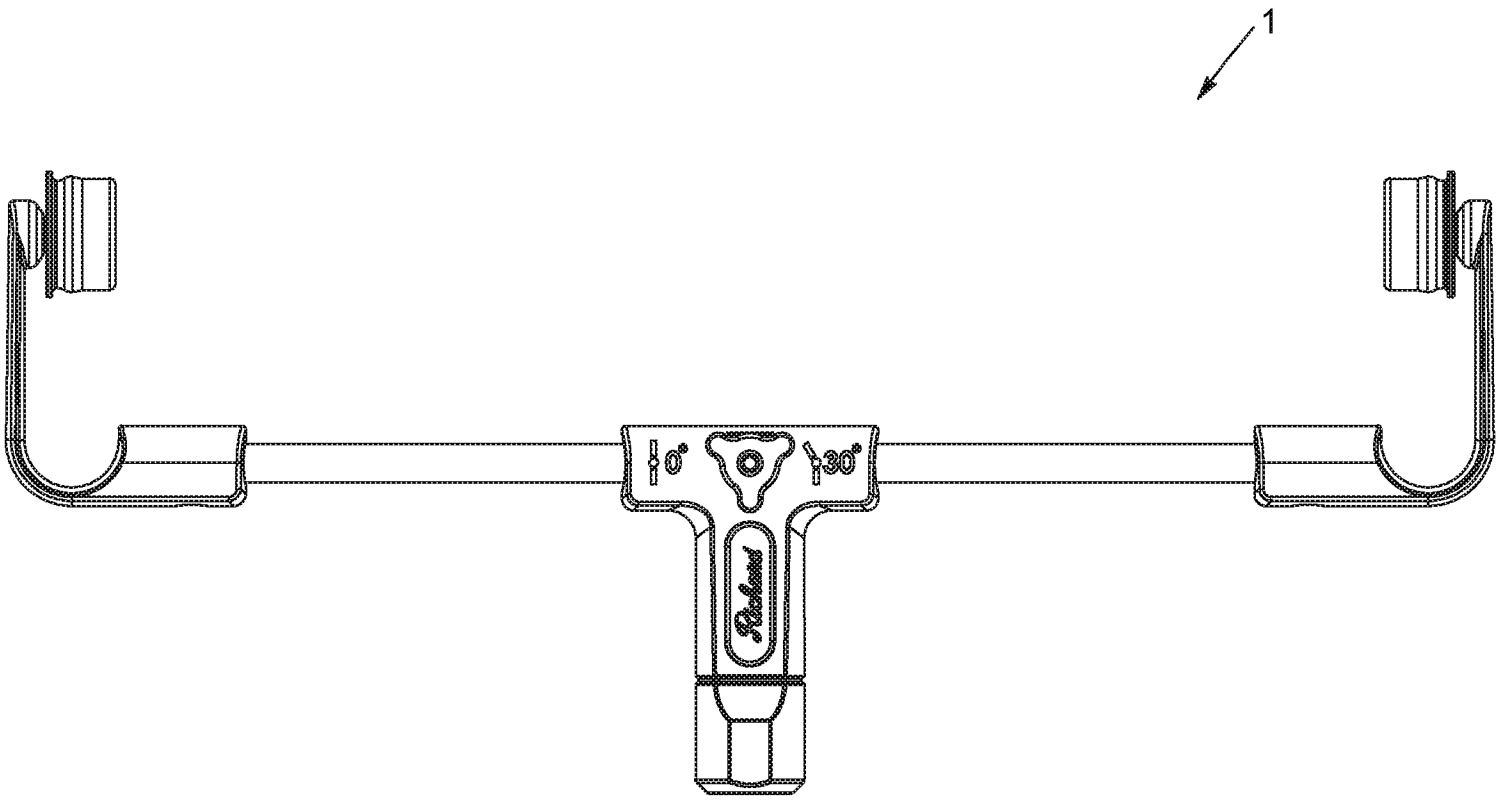
FIG. 3 is a front plan view of what is shown in FIG. 1.
Figure 4:
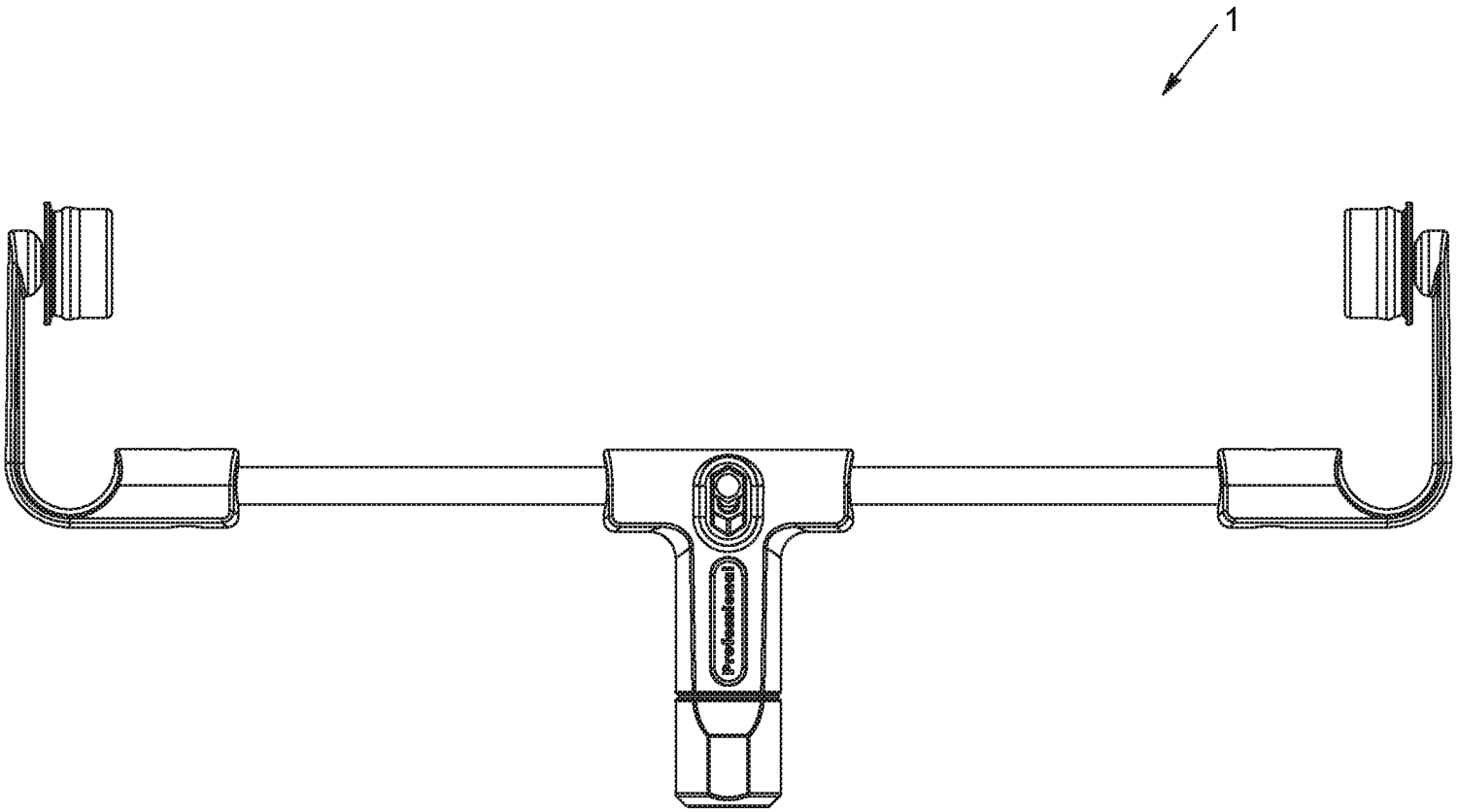
FIG. 4 is a rear plan view of what is shown in FIG. 1.
Figure 6:
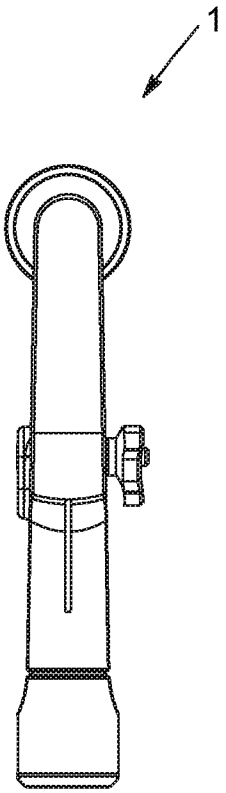
FIG. 6 is a right-hand side view of what is shown in FIG. 1.
Figure 5:
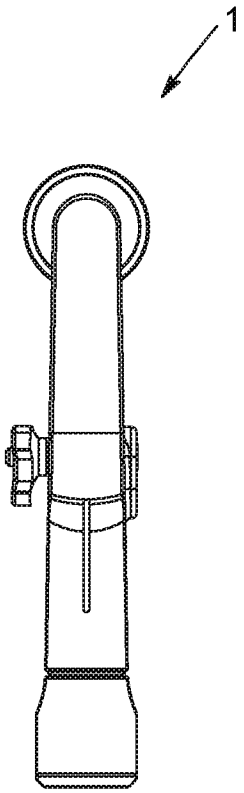
FIG. 5 is a left-hand side view of what is shown in FIG. 1.
Figure 7:
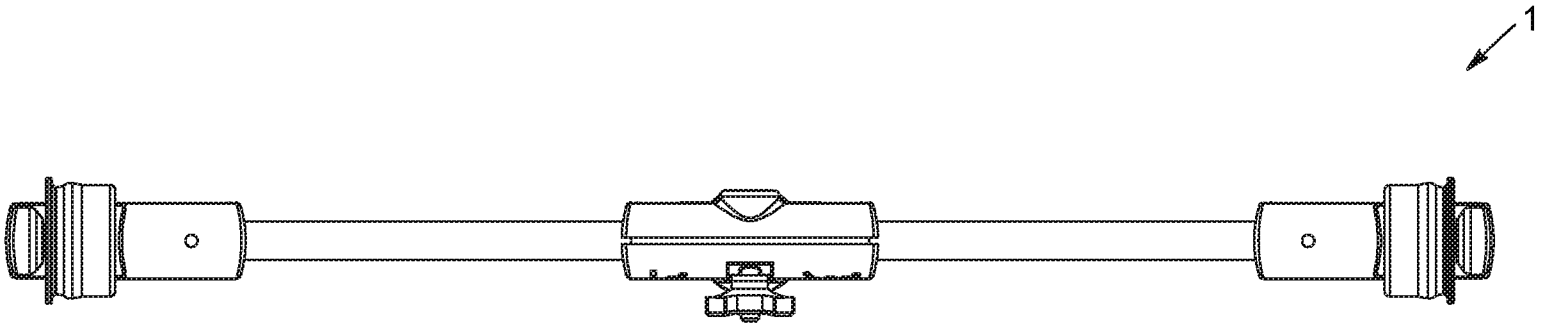
FIG. 7 is a top view of what is shown in FIG. 1.
Figure 8:
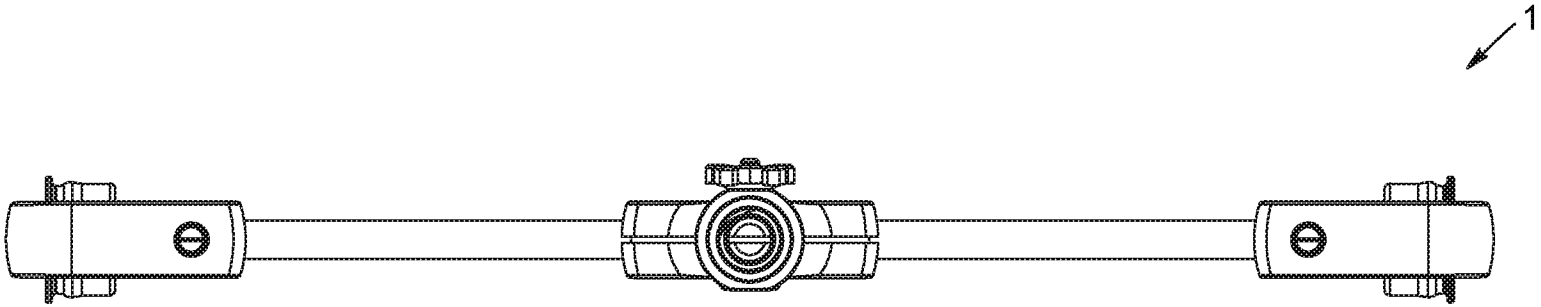
FIG. 8 is a bottom view of what is shown in FIG. 1.
Figure 9:
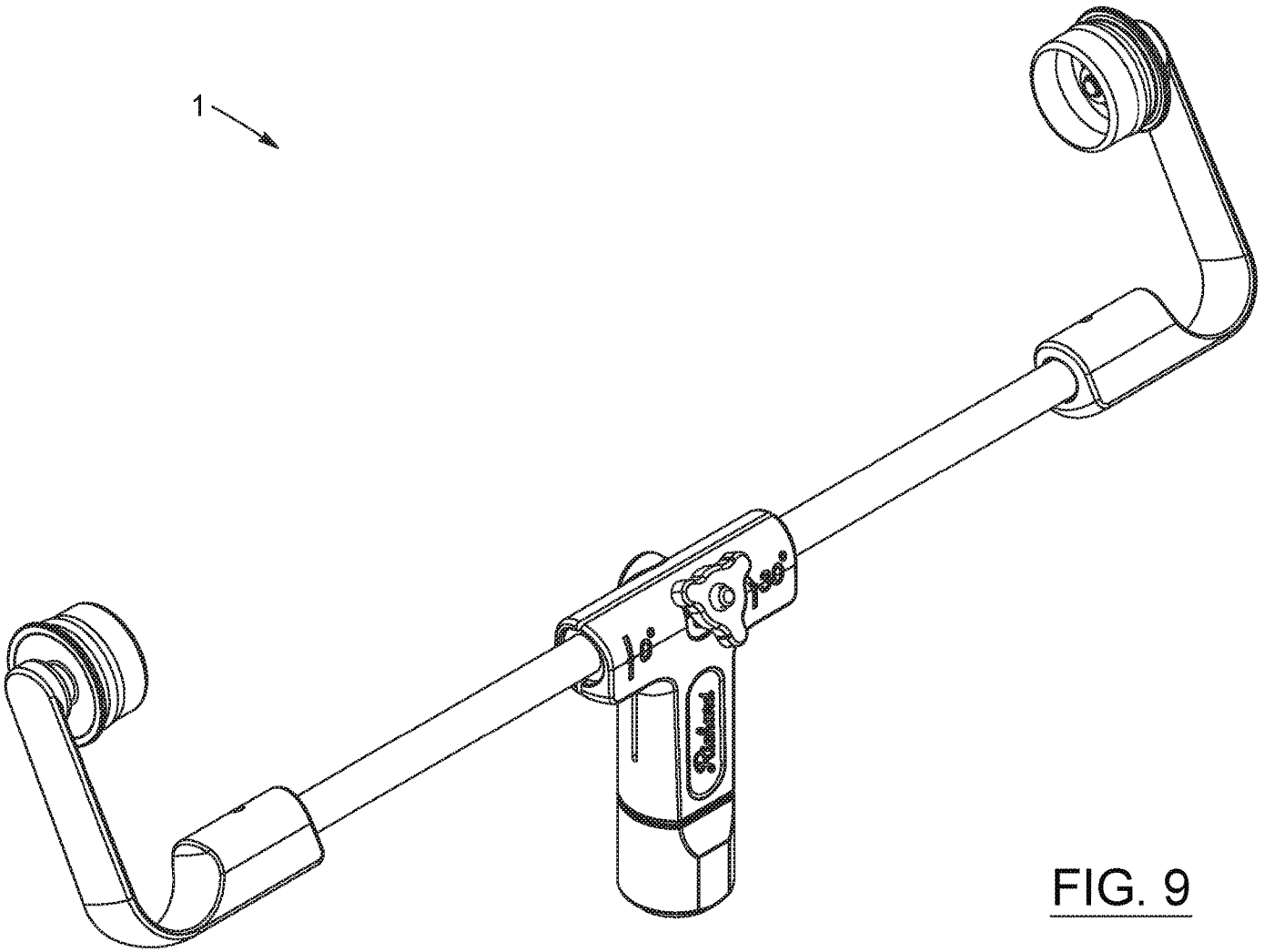
FIG. 9 is another front perspective view of what is shown in FIG. 1, the roller frame being now shown in a "slanted" configuration (ex. with the supporting components being at a given operating angle with respect to the longitudinal axis of the base component).
Figure 10:
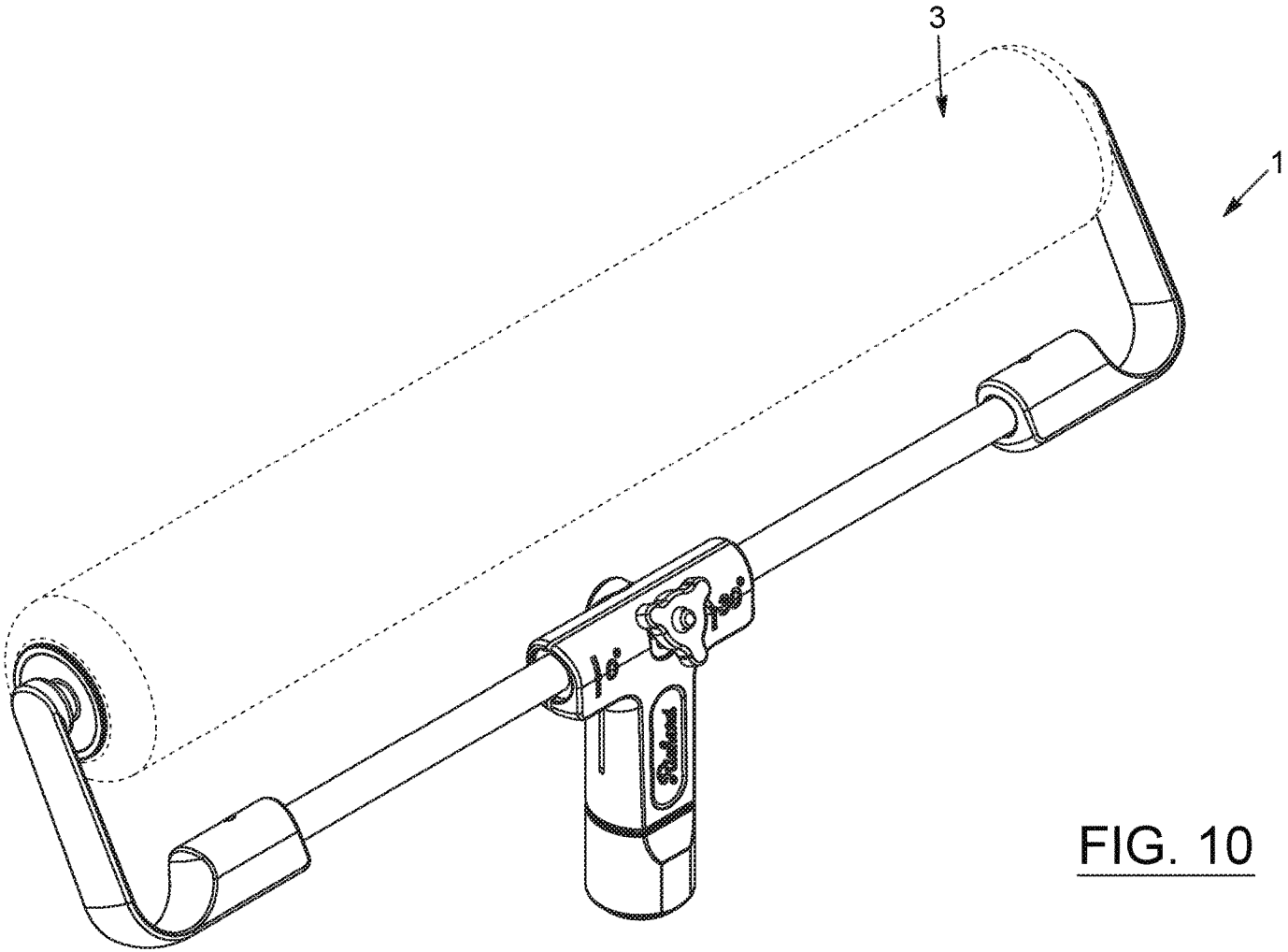
FIG. 10 is another perspective view of what is shown in FIG. 9, the roller frame being now shown provided with a corresponding paint roller mounted thereon.
Figure 13:
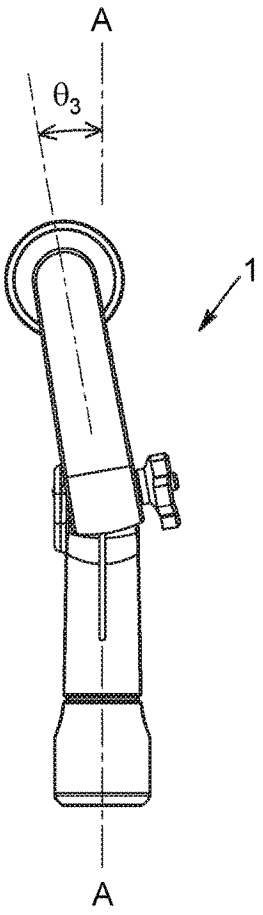
FIGS. 11-13 are side views of a roller frame according to another possible embodiment of the present invention, each view showing the roller frame disposed at a different operating angle having been secured in place via the tightening assembly of the roller frame.
Figure 12:
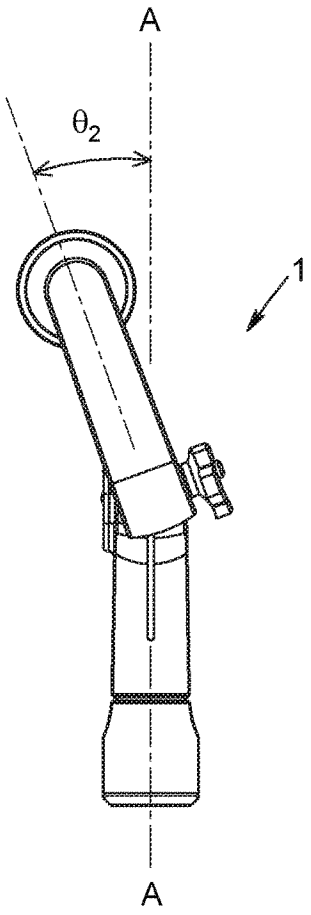
Figure 11:
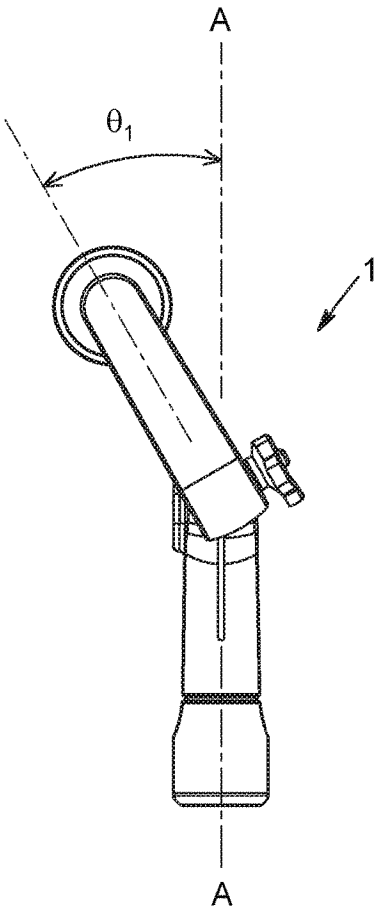

In the following description, the same numerical references refer to similar elements. Furthermore, for sake of simplicity and clarity, namely so as to not unduly burden the figures with several reference numbers, only some figures have been provided with reference numbers, and components and features of the present invention illustrated in other figures can be easily inferred therefrom. The embodiments, geometrical configurations, materials mentioned and/or dimensions (expressed in inches, for example) shown in the figures are preferred, for exemplification purposes only.

Moreover, although the present invention was primarily designed for use with a paint roller for carrying out painting applications (for example), preferably in conjunction with an extension pole and/or the like, it may be used with other objects and/or in other types of applications, as apparent to a person skilled in the art. For this reason, expressions such as "paint", "painting", "roller", "extension", "pole", etc., used herein should not be taken so as to limit the scope of the present invention and include all other kinds of objects and/or applications with which the present invention could be used and may be useful. Indeed, the present invention could be used to spread various other types of liquid-substances (ex. varnish, epoxy, tar, etc.), that is, substances to be applied and capable of "shear", and meant to be distributed (ex. "painted", spread, evened, etc.) over a given surface, etc.

Moreover, in the context of the present invention, the expressions "frame", "tool", "device", "system", "unit", "assembly", "product", as well as any other equivalent expressions and/or compound words thereof, may be used interchangeably, as apparent to a person skilled in the art. This applies also for any other mutually equivalent expressions, such as, for example: a) "paint", "liquid", "substance", etc.; b) "base", "handle", etc.; c) "fastener", "screw", "bolt", "pin", etc.; as well as for any other mutually equivalent expressions, pertaining to the aforementioned expressions and/or to any other structural and/or functional aspects of the present invention, as also apparent to a person skilled in the art.

Furthermore, in the context of the present description, it will be considered that all elongated objects will have an implicit "longitudinal axis" or "centerline", such as the longitudinal axis of a handle or a fastener, for instance, or the centerline of a bore, for example, and that expressions such as "connected" and "connectable", or "mounted" and "mountable", may be interchangeable, in that the present invention also relates to a kit with corresponding components for assembling a resulting fully-assembled and fully-operational roller frame.

Moreover, components and/or features of the present roller frame, and/or steps of the method(s) described herein, could be modified, simplified, altered, omitted and/or interchanged, without departing from the scope of the present invention, depending on the particular applications which the present invention is intended for, and the desired end results, as briefly exemplified herein and as also apparent to a person skilled in the art.

In addition, although the preferred embodiments of the present invention as illustrated in the accompanying drawings comprise various components, and although the preferred embodiments of the roller frame and corresponding parts as shown consist of certain geometrical configurations, as explained and illustrated herein, not all of these components and geometries are essential to the invention and thus should not be taken in their restrictive sense, i.e. should not be taken so as to limit the scope of the present invention. It is to be understood, as also apparent to a person skilled in the art, that other suitable components and cooperation thereinbetween, as well as other suitable geometrical configurations may be used for the roller frame and corresponding parts according to the present invention, as will be briefly explained herein and as can be easily inferred herefrom by a person skilled in the art, without departing from the scope of the present invention.

List of Numerical References for Some of the Corresponding Possible Components Illustrated in the Accompanying Drawings:

1. roller frame (or "paint roller frame")
3. roller (to be used with roller frame)
5. base component (of roller frame)
7. supporting component (of roller frame)
9. mounting cap (or "roller" cap)
11. tightening assembly
13. rigid component (of supporting component)
15. flexible component (of supporting component)
17. pivot assembly
19. pin bearing
21. hub section (of flexible component)
23. securing flange
25. shaft (of pin bearing)
27. retaining component
29. receiving body (of mounting cap)
31. abutment flange (of mounting cap)
33. protuberance
35. mounting portion (of flexible component)
37. moveable portion (of flexible component)
39. arched portion (of flexible component)
41. support rod
43. bore (of mounting portion)
45. male component
47. fastener
49. hole (of support rod)
49*a*. first side hole (of support rod)
49*b*. second side hole (of support rod)
49*c*. main hole (of support rod)
51. sleeve (of base component)
53. slit
55. first clamping portion
57. second clamping portion
59. rubberized tube
59*c*. main hole (of rubberized tube)
61. inner cavity (of base component)
63. adjustment component (of tightening assembly)
65. tightening knob
67. tightening lever
69. slot
69*a*. front slot
71. surface segment
71*a*. first surface segment
71*b*. second surface segment
73. recessed portion
73*a*. front recessed portion
75. wall (of recessed portion)
77. corresponding component (of tightening assembly)
78. Corresponding component (of tightening assembly)
79. washer
81. other component (of roller frame)
θ. angle
θ1. first operating angle
θ2. second operating angle
θ3. third operating angle
A-A. longitudinal axis (of base component of roller frame)

Broadly described, the present invention, as exemplified in the accompanying drawings, relates to a roller frame for supporting a roller and also, for example, if need may be, for allowing a corresponding rotation of said roller with respect to the roller frame, as is often necessary for painting applications, and the like. The roller frame may comprise a base component, as well as first and second supporting components operatively projecting from the base component, each supporting component having a mounting cap for receiving a corresponding distal end of the roller, with at least one, but preferably, both, of the first and second supporting components, being angularly adjustable with respect to the base component via a tightening assembly for allowing the roller to be selectively positioned at different angles with respect to the base component of the roller frame, as can be easily understood when referring to the accompanying drawings.

As can also be easily understood from the drawings, each supporting component may have a substantially rigid component and a substantially flexible component, the roller frame comprising first and second mounting caps being provided on the flexible components of the first and second supporting components respectively, said supporting components being operable between a "drawn-out" configuration where the roller is insertable between the first and second mounting caps, and a "drawn-in" configuration where the first and second mounting caps are inserted into first and second distal ends of the roller respectively.

As can also be easily understood, the first and second mounting caps can be positioned, shaped and sized for press-fittingly receiving the first and second distal ends of the roller, and according to a possible embodiment, each mounting cap is pivotably mounted about a corresponding flexible component of the roller frame via a corresponding pivot assembly, so that the roller inserted into the first and second mounting caps rotates with said mounting caps, via the pivot assembly.

Figure 16:
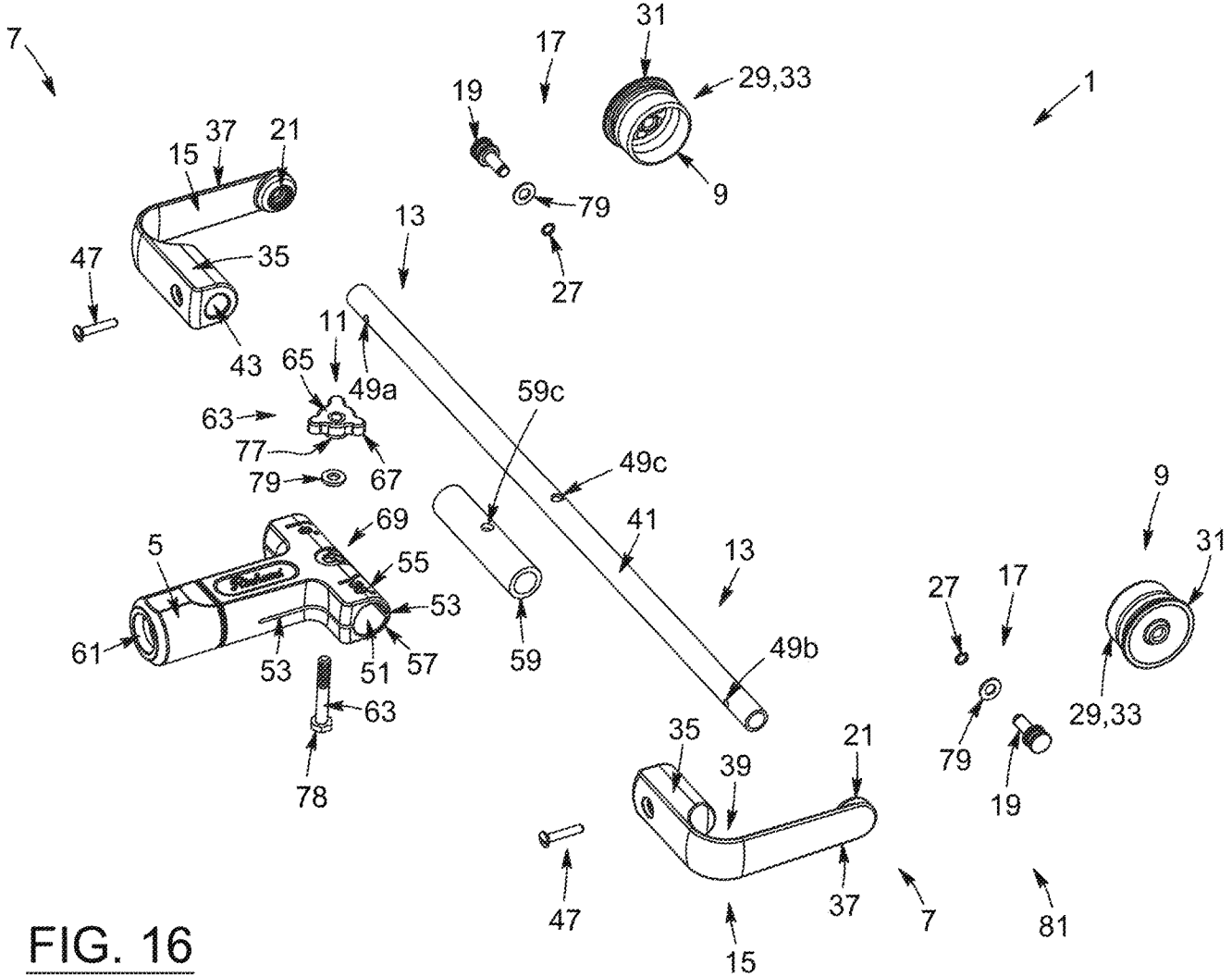
FIG. 16 is an exploded view of the components of the roller frame shown in FIG. 14.
Figure 17:
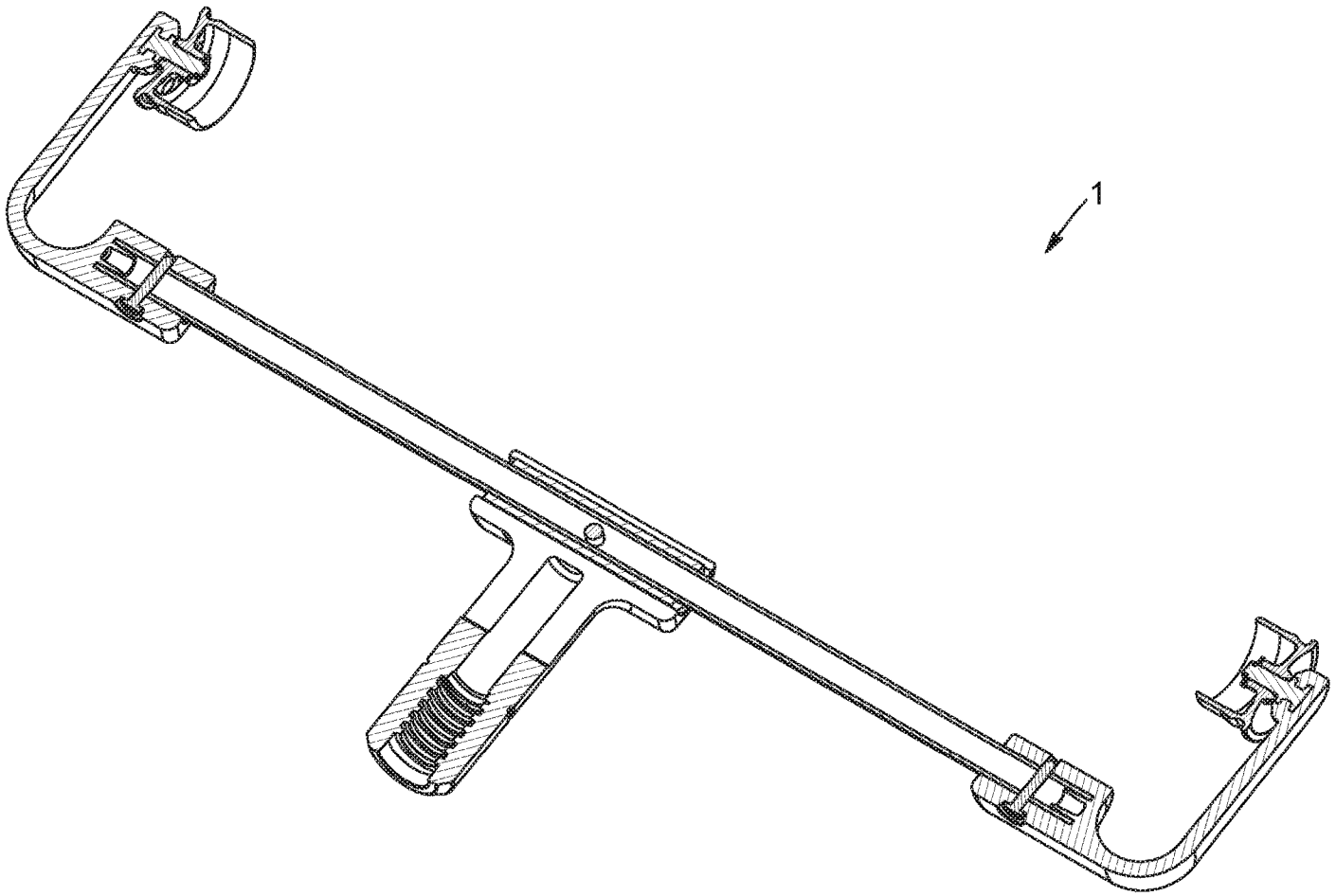
FIG. 17 is a sectional view taken along a portion of the roller frame of FIG. 14 to better illustrate inner features of some of the components of the roller frame.

The pivot assembly may include a pin bearing, and as better shown in FIG. 16, for example, and the pin bearing may be molded within a corresponding hub section of the flexible component.

Optionally also, the pin bearing may be provided with at least one securing flange for securing the pin bearing within the hub section molded about the pin bearing and corresponding at least one securing flange. According to one possible embodiment, the at least one securing flange is mounted about a portion of a shaft of the pin bearing, said at least one securing flange and portion of the shaft of the pin bearing having a substantially T-shaped cross-sectional profile. Alternatively, and according to another possible embodiment, the at least one securing flange includes a pair of securing flanges being mounted about a portion of a shaft of the pin bearing, said pair of securing flanges and portion of the shaft of the pin bearing having a substantially H-shaped cross-sectional profile, as better shown in FIG. 18, for example.

Figure 18:
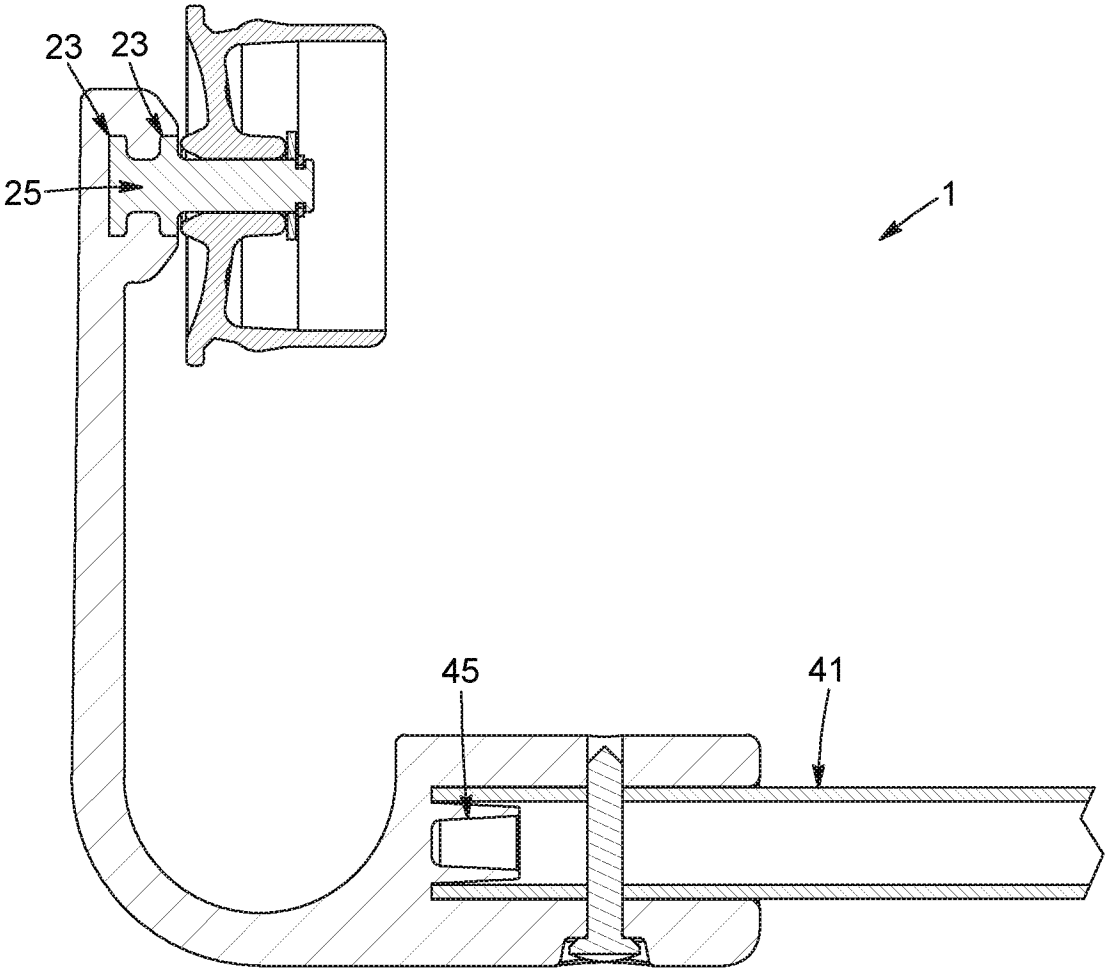
FIG. 18 is an enlarged plan view of a portion of what is shown in FIG. 17.

As shown in FIGS. 16 and 18, for instance, the pin bearing may be provided with at least one retaining component being positioned, shaped and sized about an inner part of each mounting cap for retaining said mounting cap against a corresponding flexible component of the roller frame.

Optionally also, each mounting cap may comprise a receiving body and an abutment flange, the abutment flange being positioned, shaped and sized for abutting against a corresponding rim of the roller. The receiving body of each mounting cap may be provided with at least one circumferential protuberance for increasing a press-fitting interaction with the roller, and the at least one circumferential protuberance can be provided circumferentially (ex. continuously and/or discontinuously) about the receiving body of the mounting cap.

Figure 14:
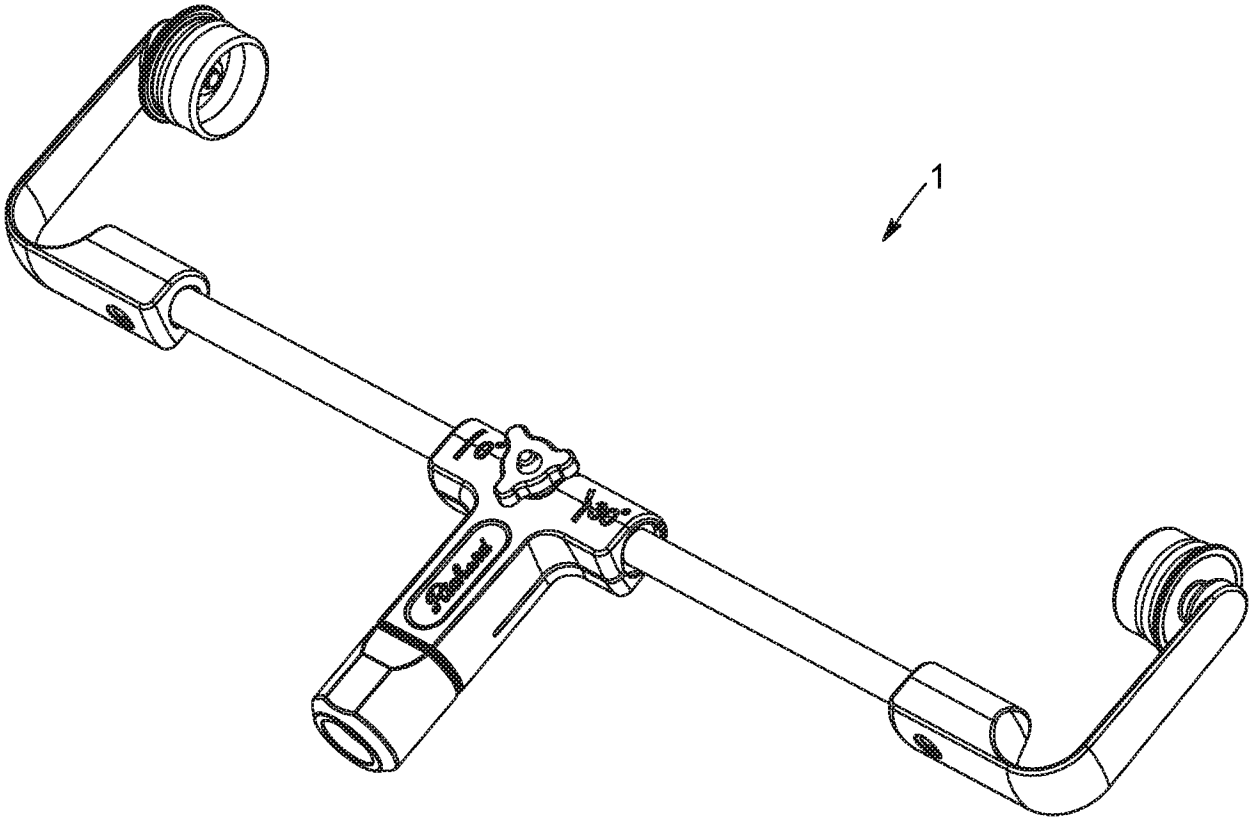
FIG. 14 is a top perspective view of a roller frame according to another possible embodiment of the present invention.
Figure 15:
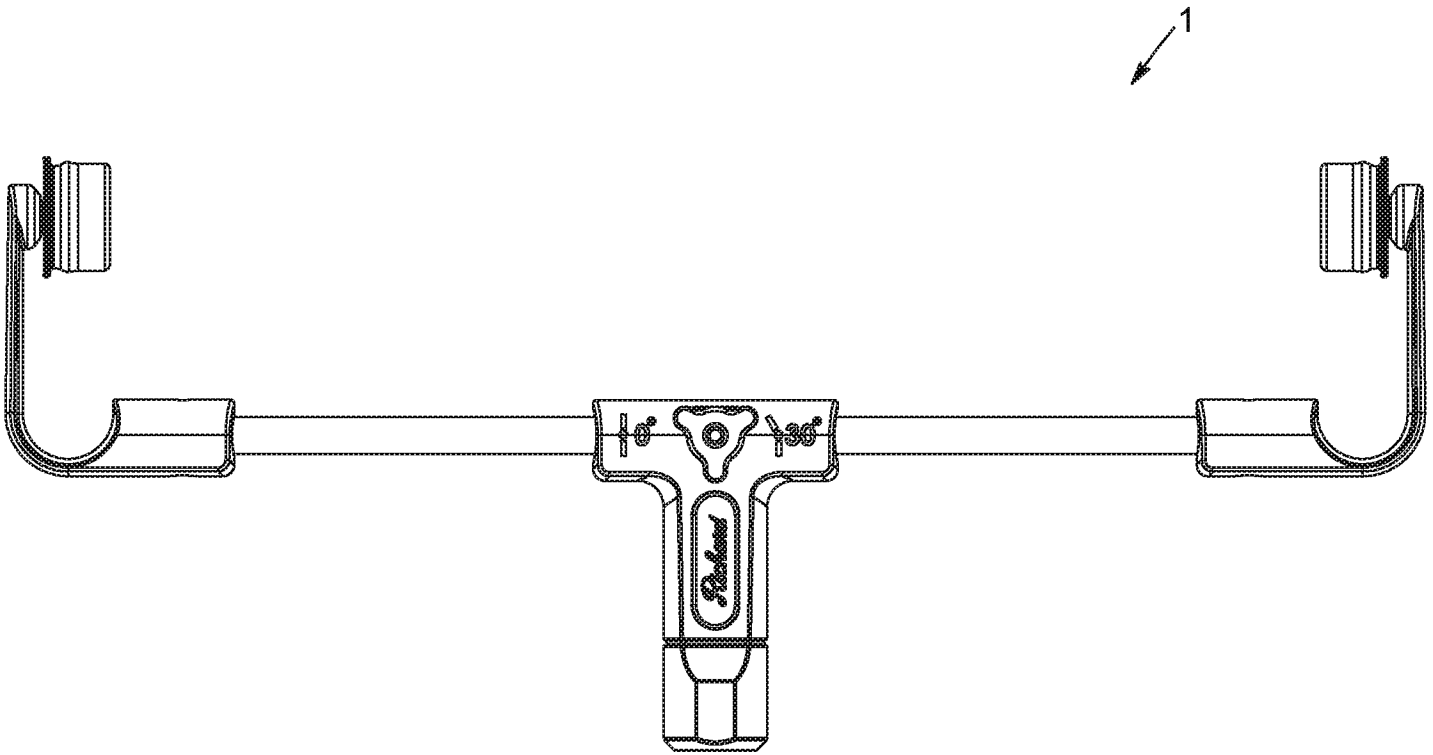
FIG. 15 is a front plan view of what is shown in FIG. 14.

As better shown in FIGS. 14-16, for example, each flexible component of each supporting component may be substantially L-shaped, including a substantially fixed mounting portion and a substantially resilient moveable portion.

According to a possible embodiment, each flexible component of each supporting component is provided with an arched section for facilitating corresponding lateral deviation (and/or "bending", "spreading apart", etc.) of the flexible component of the supporting component.

According to another possible embodiment, the mounting portion of each flexible component of each supporting component is mechanically connectable to a corresponding support rod being pivotably rotatable with respect to the base component of the roller frame.

Optionally, the mounting portion of each flexible component of each supporting component may include a bore for receiving a corresponding extremity of the support rod, and the bore may be provided with a male component being removably insertable into a corresponding distal end of the support rod, as better shown in FIGS. 16 and 18, for example.

Optionally also, the mounting portion of each flexible component of each supporting component is securely connectable to the corresponding support rod via at least one fastener insertable into the mounting portion and into the support rod.

The support rod may be a hollow support rod, for example. This has the advantage of reducing the amount of material being used for manufacturing and assembling the roller frame, and also enables for a "lighter-weight" roller frame. The roller frame may also include a common support rod for receiving the mounting portions of both the first and second supporting components of the roller frame, so that rotation of one in turn a rotation of the other, and vice-versa.

Figures 19, 20, 21:
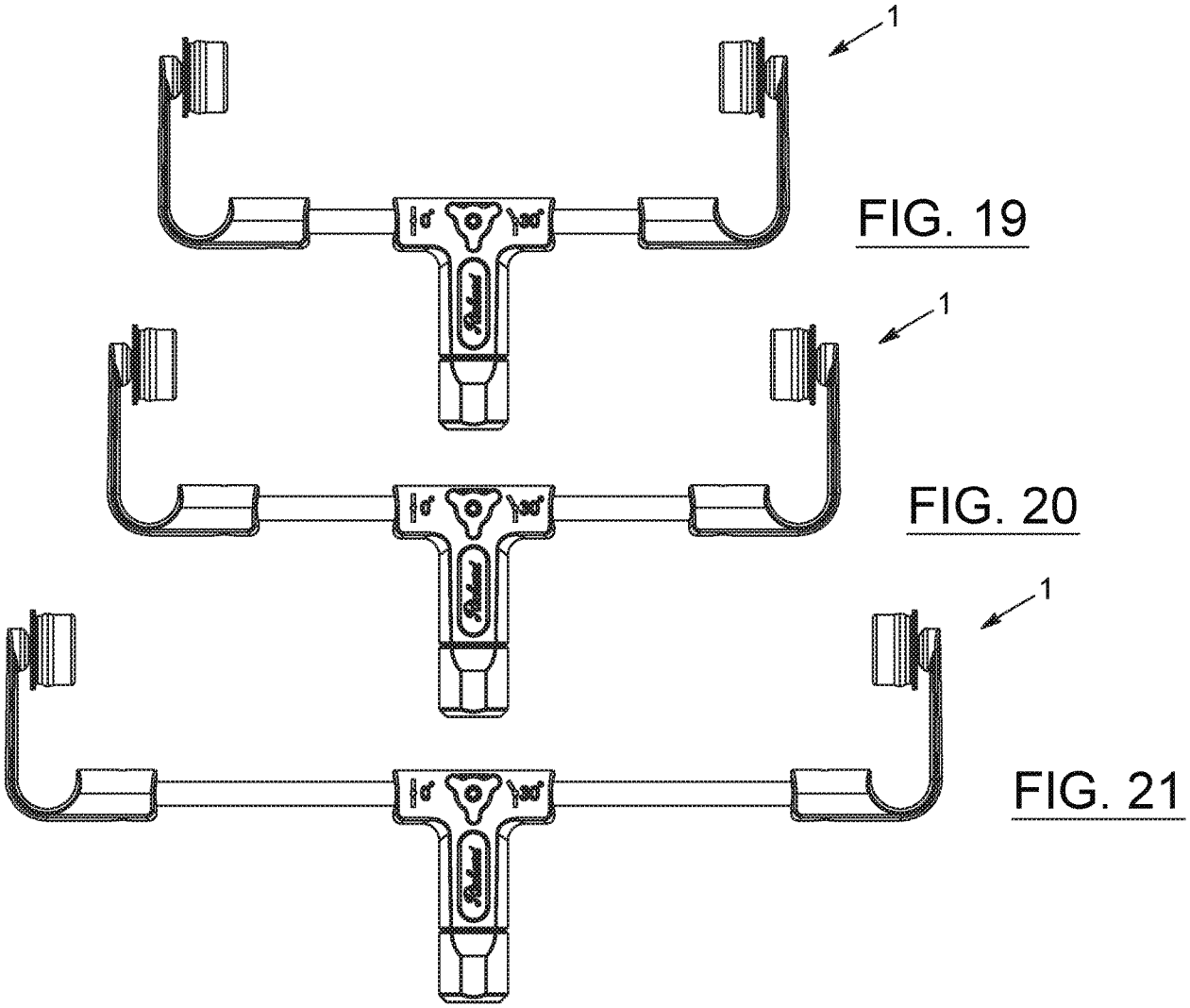
FIGS. 19, 20 and 21 are front views of roller frames according to different possible embodiments of the present case, to better illustrate how the same components of a given roller frame can be used with support rods of varying lengths to accommodate different lengths of paint rollers.
Figure 22:
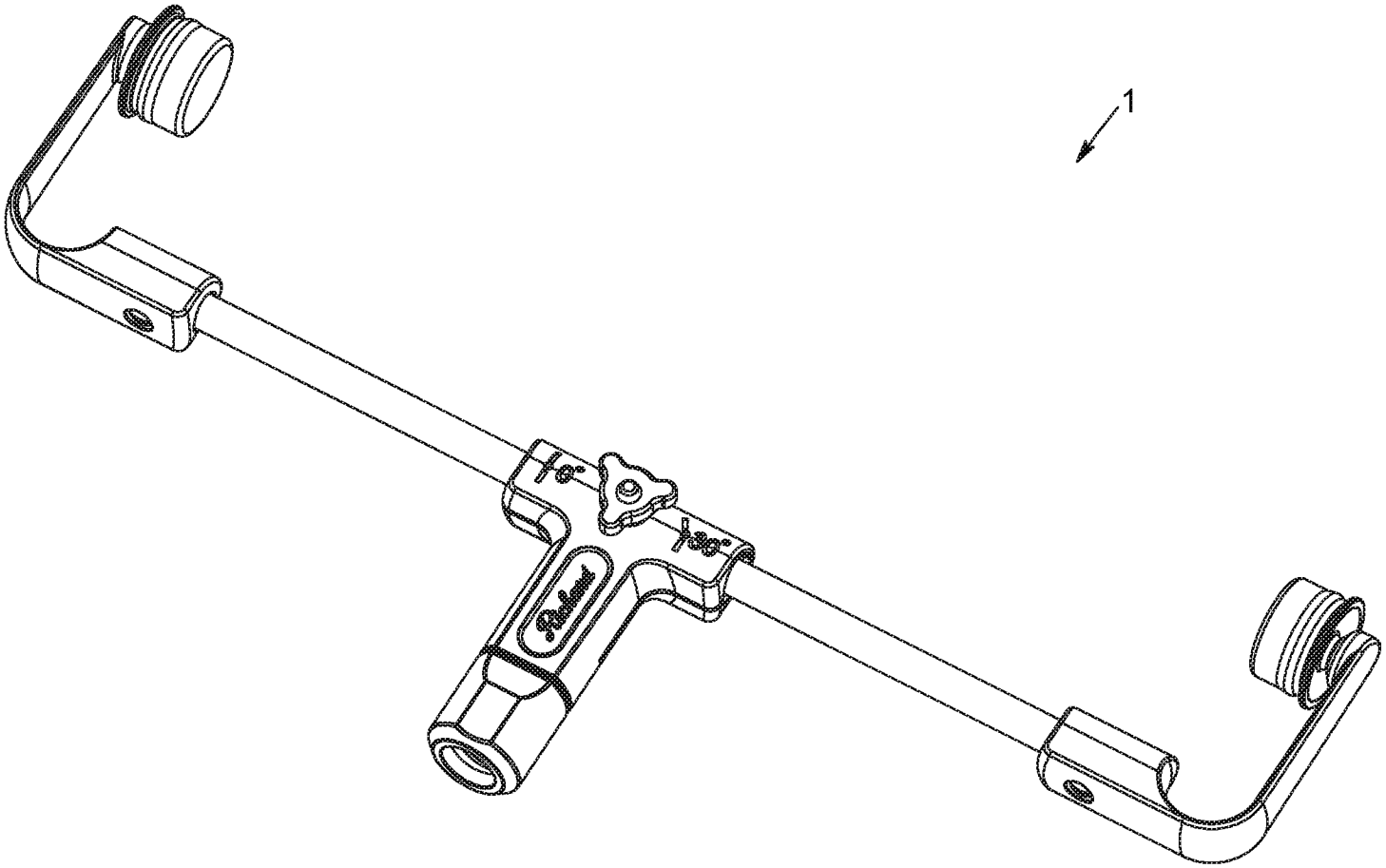
FIG. 22 is another top perspective view of what is shown in FIG. 14.
Figure 23:
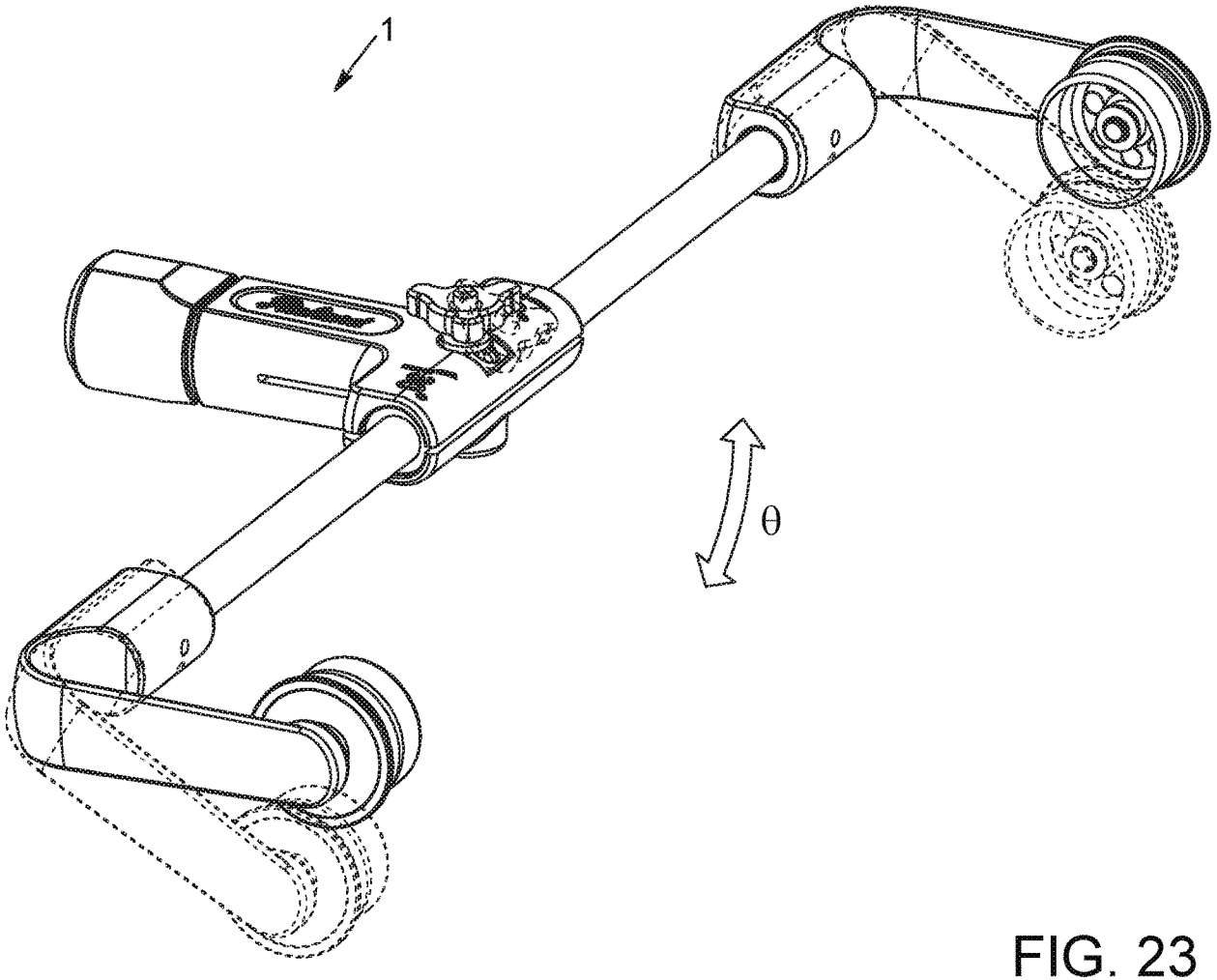
FIG. 23 is another top perspective view of what is shown in FIG. 22, the roller frame being shown with its supporting components at a first major operating angle (ex. at about 0°), and with the same supporting components and corresponding tightening assembly being shown schematically at another major operating angle (ex. at about 30°).
Figure 24:
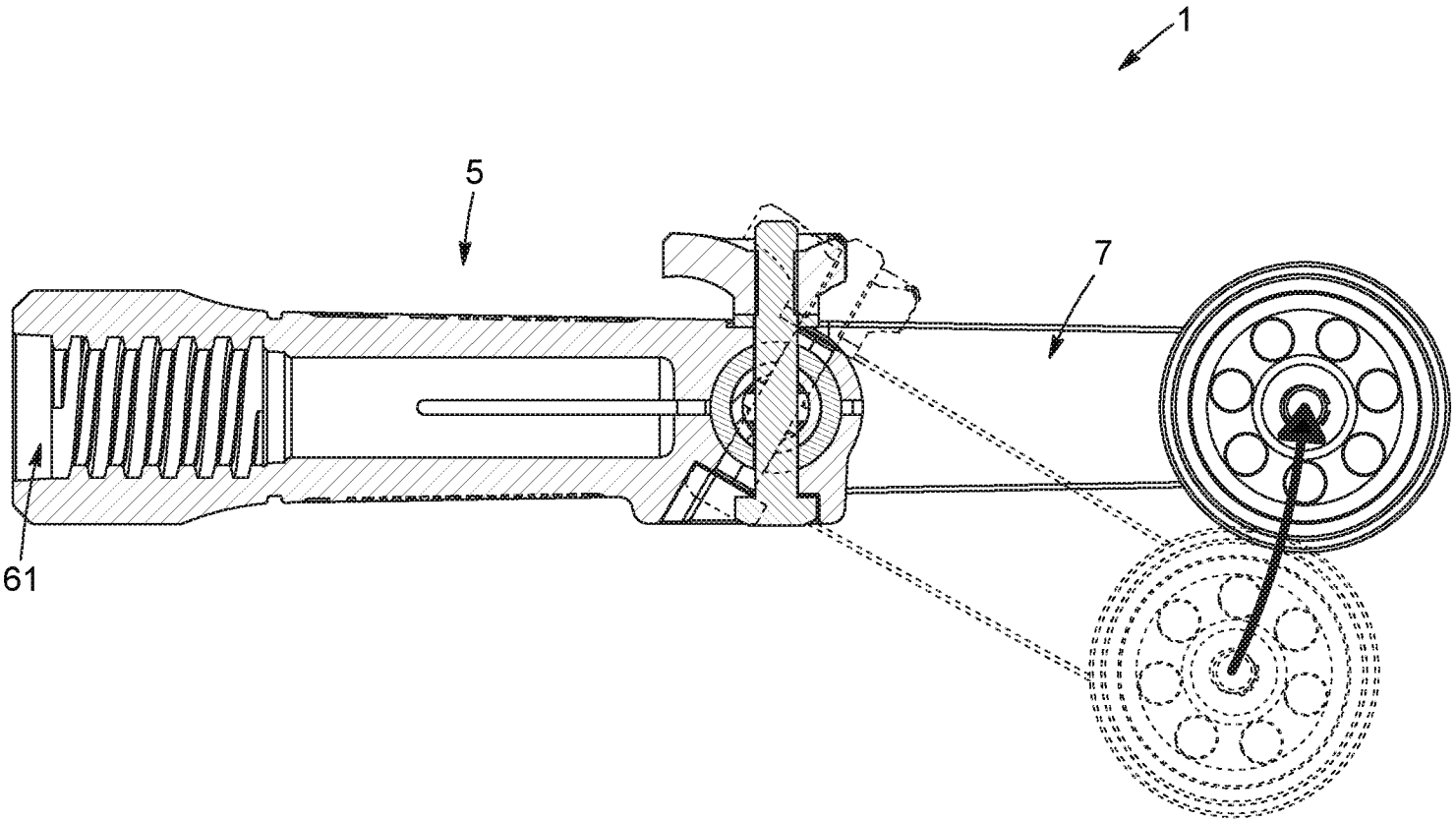
FIG. 24 is a cross-sectional view taken along a longitudinal vertical plane of what is shown in FIG. 23.

As better shown in FIGS. 19, 20 and 21, for example, this illustrates how the same components of a given roller frame can be used with support rods of varying lengths to accommodate different lengths of paint rollers, and further shows how the present system enables a manufacturer, a distributor, a wholesaler and/or a retailer, to have a reduced number of parts, inventory, etc., which is also advantageous, for obvious reasons.

The support rod may comprise at least one hole for receiving a corresponding fastener, and according to a possible embodiment, the support rod comprises a pair of lateral or side holes for receiving first and second fasteners intended to securely connect the mounting portions of the first and second supporting components respectively onto the support rod.

As better shown in FIGS. 16, 25, 26 and 27, for example, the base component comprises a corresponding sleeve being positioned, shaped and sized for receiving the support rod, the sleeve being provided with at least one slit for defining first and second clamping portions of the sleeve configured to move with respect to one another, in order to be selectively operated in a "clamping" configuration where the first and second clamping portions of the sleeve are securely clamped against the support rod so as to securely immobilize the same, and an "adjustment" (or "rotating", "pivotating", etc.) configuration where the support rod is allowed to adjustably rotate with respect to the sleeve and corresponding base component of the roller frame.

The roller frame may also comprise a rubberized tube being provided about a portion of the support rod contained within the sleeve of the base component for assisting in a frictional engagement between the sleeve and corresponding support rod when the latter is selectively secured by the tightening assembly.

According to a possible embodiment, the rubberized tube may comprise a main hole being complementary to the main hole of the support rod, and through which the adjustment component of the tightening assembly is intended to pass, etc.

As shown, in the accompanying drawings, the base component may be configured to have a substantially T-shaped profile, and so that the sleeve extends along a top portion (i.e. "cross portion", for example) of the base component.

A bottom portion of the of the base component may be provided with an inner cavity being positioned, shaped and sized to cooperate with a complementary tool to be used with the roller frame, and more particularly, the bottom portion of the base component may be threaded for threadedly receiving a corresponding extension pole, for example.

Referring back to the support rod, it may comprise a main hole for receiving a corresponding adjustment component of the tightening assembly.

According to a possible embodiment, the adjustment component is positioned, shaped and sized for extending through the base component of the roller frame (and/or corresponding sleeve thereof, for example), and optionally also, the adjustment component is threaded and is configured for cooperating with a corresponding threaded tightening knob, in order to selectively urge first and second clamping portions of the base component (ex. first and second clamping portions of the sleeve) towards one another, in order to in turn selectively maintain the support rod and corresponding supporting components of the roller frame at a fixed operating angle.

Figure 25:
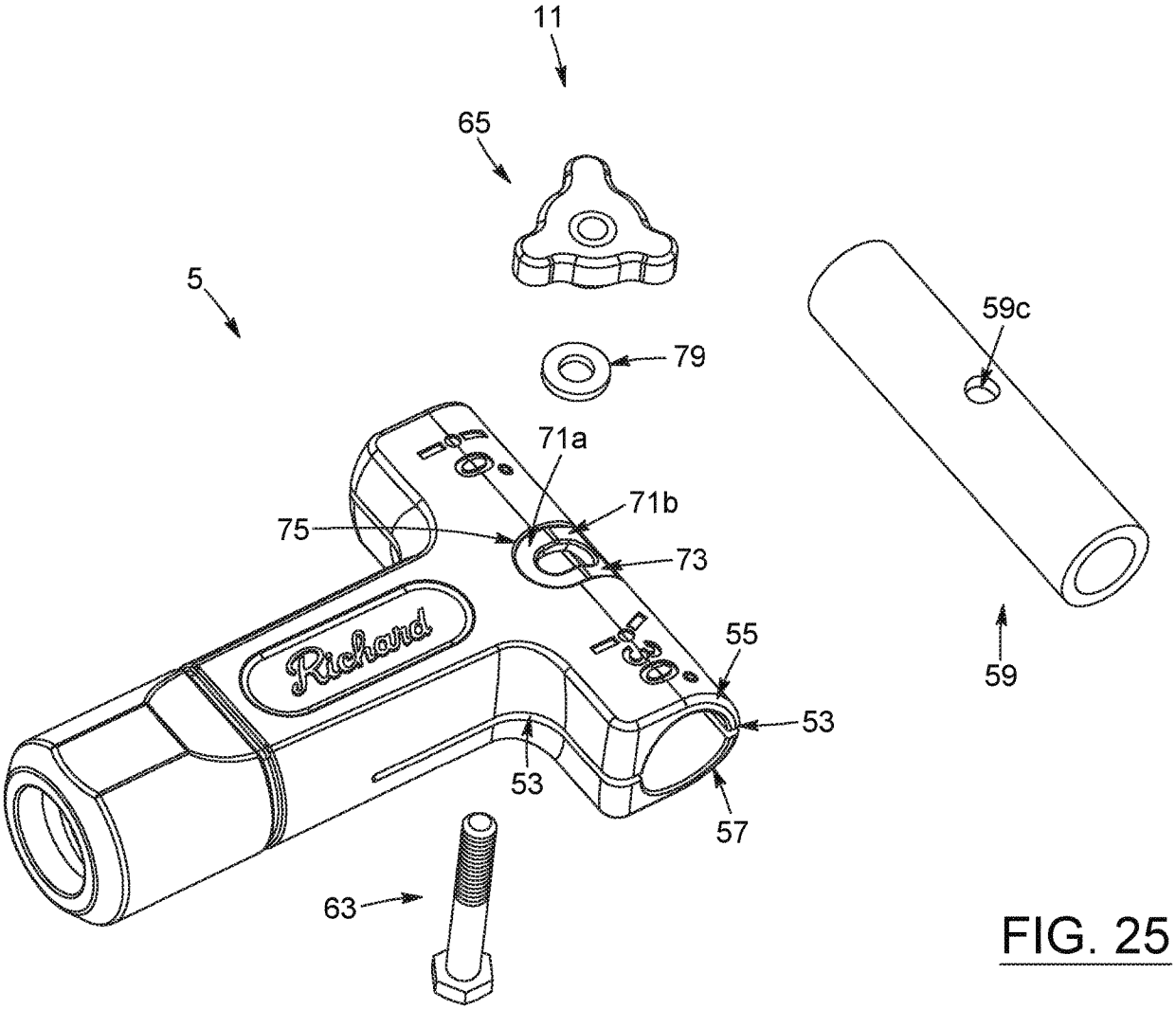
FIG. 25 is a top perspective view of some of the components shown in FIG. 14, including base component, corresponding tightening assembly and associated rubberized tube.
Figure 26:
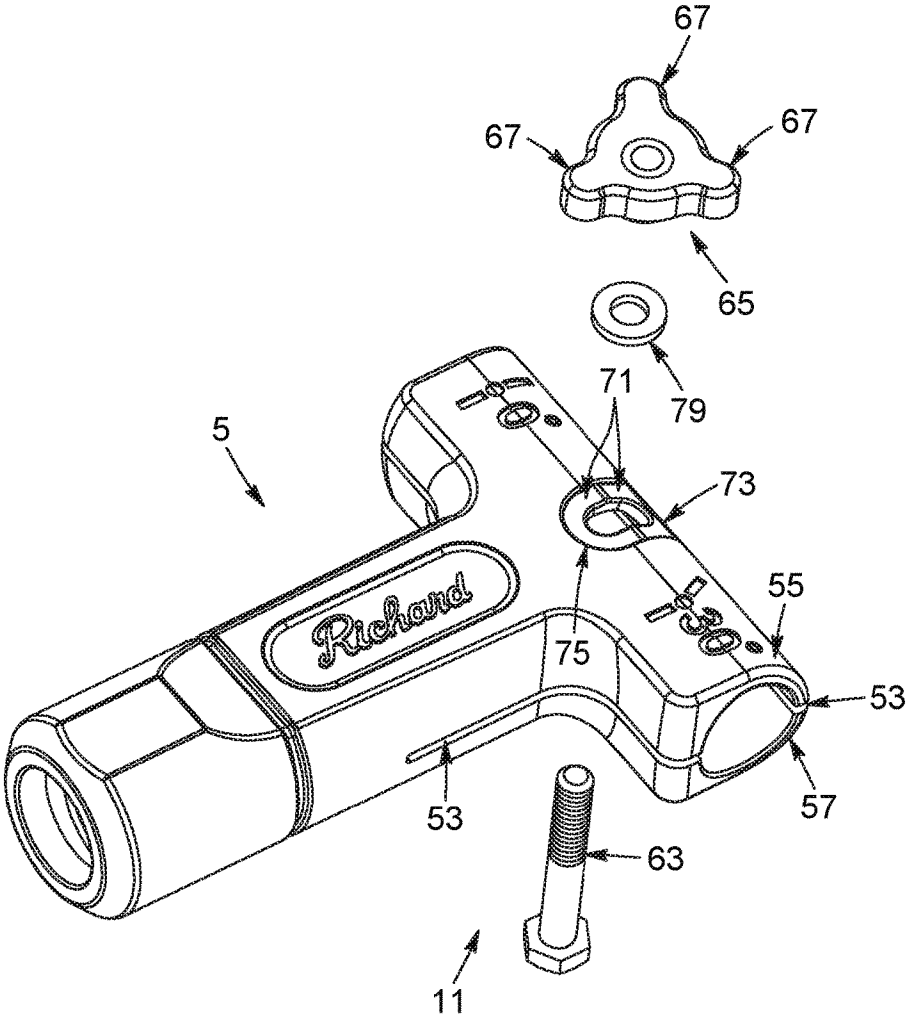
FIG. 26 is an enlarged view of some of the components shown in FIG. 25.
Figure 27:
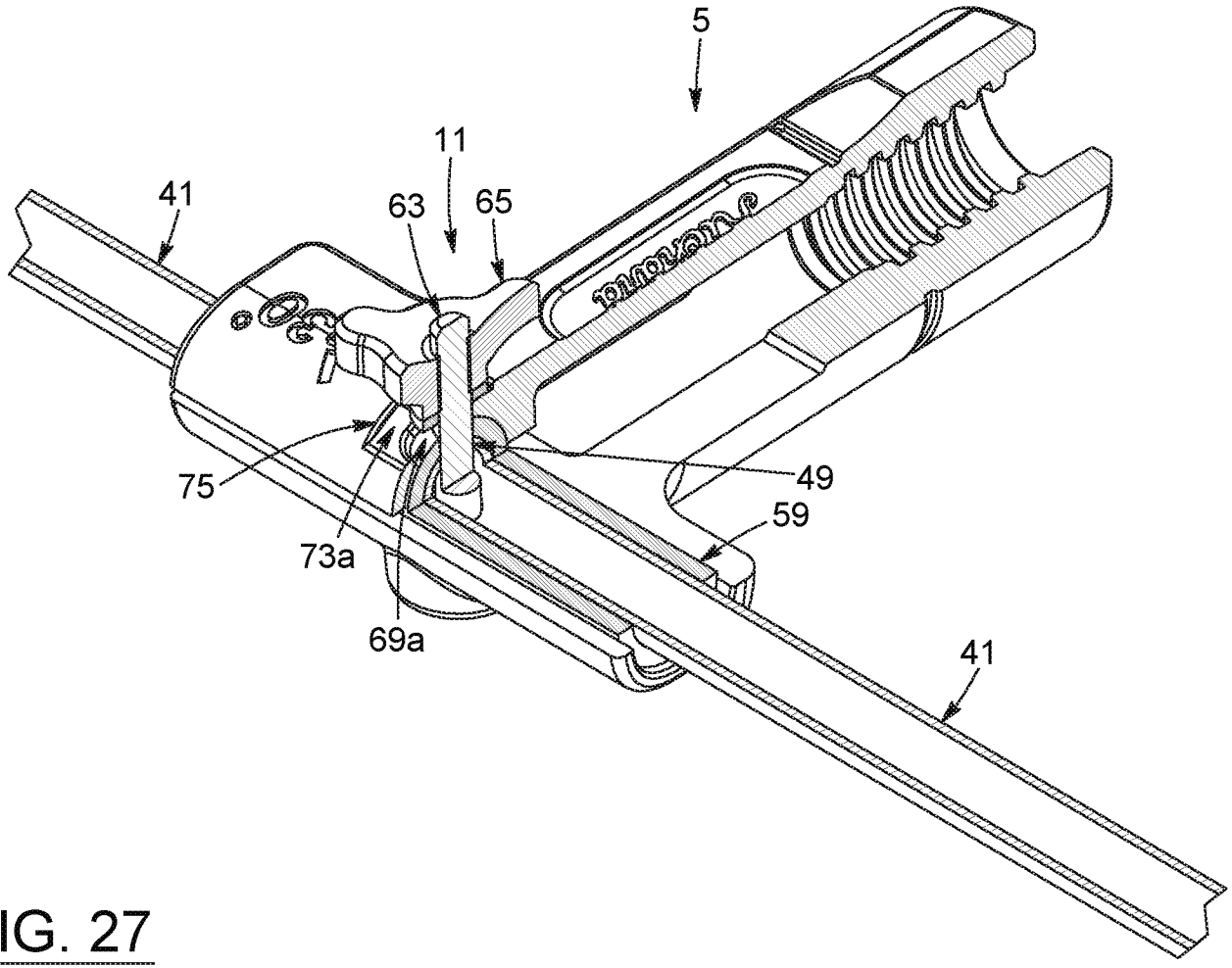
FIG. 27 is a top perspective view of a base component and corresponding tightening assembly cooperating with a portion of a corresponding support rod of the roller frame according to a possible embodiment of the present invention, certain given components being shown sectionally cut-away to better illustrate inner features and cooperation of these given components according to this particular possible embodiment of the roller frame.
Figure 28:
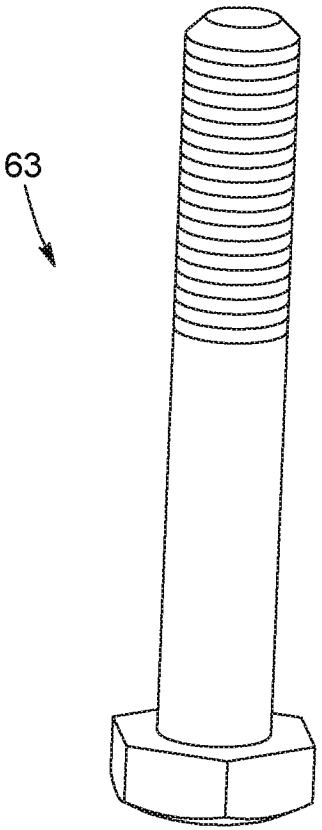
FIG. 28 is a perspective view of a tightening fastener according to a possible embodiment of the present invention.

According to a possible embodiment, the tightening knob may be provided with at least one tightening lever, and more particularly, may be provided with three tightening levers, for example, these tightening levers being spaced angularly equidistantly from one another about the tightening knob, for example, as better shown in FIGS. 25-27, for instance.

Of course, various other types, shapes, forms and/or configurations of tightening knobs, with various other types and/or numbers of gripping portions, may be used for the present roller frame, as can be easily understood by a person skilled in the art.

Irrespectively of the nature of the tightening knob and/or tightening mechanism used for the tightening assembly, an object of the present system is to provide a roller frame capable of being adjustable with respect to a base component thereof, in order to selectively choose an optimal and/or preferred operating angle of work (ex. for painting, etc.) with the roller frame. Indeed, the way in which one and/or both of the first and second supporting components of the roller frame are angularly adjustable with respect to the base component via the tightening assembly for allowing the roller to be selectively positioned at different angles with respect to the base component of the roller frame, can take on various different shapes, forms and/or configurations, as can also be easily understood by a person skilled in the art.

For example, according to a one possible embodiment, the adjustment component of the tightening assembly may be positioned, shaped and sized for extending along at least one slot (ex. a "guiding" slot, an "adjustment" slot, a "selection" slot, etc.) defined about the base component, and more particularly, about a corresponding side and/or portion of said base component.

For example, the roller frame may comprise front and rear slots being provided respectively about front and rear sides of the base component.

As can be easily understood when referring to the accompanying drawings, each slot may be provided with different surface segments corresponding to different positions of the adjustment component, thereby in turn causing the first and second supporting components of the roller frame to rotate with respect to the base component via the tightening assembly, for allowing the roller frame to be selectively positioned at different incremental angles with respect to the base component.

Optionally also, the different surface segments of each slot are positioned, shaped and sized so as to allow the first and second supporting components to rotate with respect to the base component along angle increments, the angle increments being selected from the group consisting of about 5, 10, 15, 20, 25, 30, 35, 40, 45 and 90 degrees, for example. Other types of angle increments may also be used for the present roller frame, depending on the particular applications for which the roller frame is intended for, and the desired end results, etc.

According to a particular possible embodiment, the different surface segments of each slot are positioned, shaped and sized so as to allow the first and second supporting components of the roller frame to rotate with respect to the base component between two different major angle configurations. In most of the embodiments shown in the accompanying drawings, for example, the roller frame is configured so that a first major angle configuration is about 0 degree(s) with respect to a longitudinal axis of the base component, and so that a second major angle configuration is about 30 degrees with respect to the longitudinal axis of the base component. Of course, and once again, various other types and/or numbers of angle configurations, may be used for the present roller frame, as can be easily understood by a person skilled in the art.

According to yet another possible embodiment, each slot is provided within a corresponding recessed portion defined about the base component, the recessed portion comprising a corresponding peripheral wall for guiding movement of a corresponding component of the tightening assembly. Optionally, the front slot may comprise and/or be contained within a corresponding front recessed portion defined about the base component, the front recessed portion comprising a corresponding peripheral wall for guiding movement of a corresponding component (ex. washer, tightening knob, etc.) of the tightening assembly. Optionally also, the rear slot may comprise and/or be contained within a corresponding rear recessed portion defined about the base component, the rear recessed portion comprising a corresponding peripheral wall for guiding movement of a corresponding portion (ex. head, etc.) of the adjustment component of the tightening assembly, and thus, the adjustment component of the tightening assembly may be a bolt, for example.

Similarly to what was previously explained, irrespectively of the nature of the adjustment mechanism/manner and/or tightening assembly used for the present roller, the present roller frame is meant to be capable of being adjusted in angle with respect to a base component, in order to selectively choose an optimal and/or preferred operating angle of work (ex. painting, etc.) for the roller frame. Indeed, the way in which one and/or both of the first and second supporting components of the roller frame are angularly adjustable with respect to the base component can come in various different shapes, forms and/or configurations, as can also be easily understood by a person skilled in the art.

According to one possible intended use, the roller frame is a paint roller frame configured for receiving a corresponding paint roller being removably mountable onto the first and second mounting caps, although it is worth mentioning, once again, that the present roller frame could be used to spread various other types of liquid-type substances (ex. varnish, epoxy, tar, etc.), that is, substances capable of shear, and meant to be distributed and/or spread over a given work surface, etc., as can also be easily understood by a person skilled in the art.

As may now better be appreciated, the present invention is a substantial improvement over the prior art in that, by virtue of its design and components, as explained hereinabove, the present roller frame enables a user, to carry out panting applications and/or work with corresponding paint rollers, for example, in a more efficient, more precise, more accurate, more reliable, more adjustable, more versatile, more adaptable, more ergonomic and/or more desirable manner, compared to what is possible with respect to other known conventional paint roller frames and/or painting methods.

When compared to other conventional paint roller frames, the present roller frame is also quite advantageous in that: a) the handle can be conveniently rotated from one operating angle (ex. 0°, when working on "walls", for instance) to another operating angle (ex. 30°—when working on "floors", for instance); b) it enables an "even pressure" on both sides of the roller cover; c) it does not have "loose" parts, and stays in one piece while painting; d) it helps a user to minimize getting dirty with paint because the user can simply use and operate (i.e. "spread-apart") the flexible arms of the roller frame, without touching the actual roller; e) etc.

Indeed, and as also previously explained, the present system is particularly advantageous in that, due to its components and features, it enables namely to offer a paint roller frame capable of being selectively adjustable with respect to a base component thereof, in order to, for example, selectively and incrementally choose an optimal and/or preferred operating angle of painting, depending on the particular circumstances, intended results, and/or various other considerations, factors, etc.

Of course, and as can be easily understood by a person skilled in the art, the scope of the claims should not be limited by the possible embodiments set forth in the examples, but should be given the broadest interpretation consistent with the description as a whole.

Furthermore, although preferred embodiments of the present invention have been briefly described herein and illustrated in the accompanying drawings, it is to be understood that the invention is not limited to these embodiments and that various changes and modifications could be made without departing from the scope and spirit of the present invention, as defined in the appended claims and as apparent to a person skilled in the art.

The invention claimed is:

1. A roller frame for supporting a roller, the roller frame comprising:

a base component;

first and second supporting components operatively projecting from the base component;

first and second mounting caps provided respectively on the first and second supporting components for receiving respectively first and second distal ends of the roller;

the first and second supporting components being angularly adjustable with respect to the base component via a tightening assembly for allowing the roller to be selectively positioned at different angles with respect to the base component of the roller frame;

wherein each supporting component has a substantially rigid component and a substantially flexible component, and wherein the first and second mounting caps are provided on the flexible components of the first and second supporting components respectively, said supporting components being operable between a drawn-out configuration wherein the roller is insertable between the first and second mounting caps, and a drawn-in configuration wherein the first and second mounting caps are inserted into first and second distal ends of the roller respectively; wherein the first and second mounting caps are positioned, shaped and sized for press-fittingly receiving the first and second distal ends of the roller; and wherein each mounting cap is pivotably mounted about a corresponding flexible component of the roller frame by a corresponding pivot assembly, so that the roller inserted into the first and second mounting caps rotates with said mounting caps; and wherein the pivot assembly includes a pin bearing; wherein the pin bearing is molded within a corresponding hub section of the flexible component wherein the pin bearing is provided with at least one securing flange for securing the pin bearing within the hub section; and wherein the pin bearing is provided with at least one retaining component being positioned, shaped and sized about an inner part of each mounting cap for retaining said mounting cap against a corresponding flexible component of the roller frame.

2. The roller frame according to claim 1, wherein each mounting cap comprises a receiving body and an abutment flange, the abutment flange being positioned, shaped and sized for abutting against a corresponding rim of the roller; wherein the receiving body of each mounting cap is provided with at least one protuberance for increasing a press-fitting interaction with the roller; and wherein the at least one protuberance is provided circumferentially about the receiving body of the mounting cap.

3. The roller frame according to claim 2, wherein each flexible component of each supporting component is substantially L-shaped, including a substantially fixed mounting portion and a substantially resilient moveable portion; and wherein each flexible component of each supporting component is provided with an arched section for facilitating corresponding lateral deviation of the flexible component of the supporting component.

4. The roller frame according to claim 3, wherein the mounting portion of each flexible component of each supporting component is mechanically connectable to a corresponding support rod being pivotably rotatable with respect to the base component of the roller frame; wherein the mounting portion of each flexible component of each supporting component includes a bore for receiving a corresponding extremity of the support rod; and wherein the bore is provided with a male component being removably insertable into a corresponding distal end of the support rod.

5. The roller frame according to claim 4, wherein the mounting portion of each flexible component of each supporting component is securely connectable to the corresponding support rod via at least one fastener insertable into the mounting portion and into the support rod.

6. The roller frame according to claim 4, wherein the support rod is a hollow support rod; and wherein the support rod comprises at least one hole for receiving a corresponding fastener.

7. The roller frame according to claim 6, wherein the base component comprises a corresponding sleeve being positioned, shaped and sized for receiving the support rod, the sleeve being provided with at least one slit for defining first and second clamping portions configured to move with respect to one another, in order to be selectively operated in a clamping configuration where the first and second clamping portions of the sleeve are clamped against the support rod so as to securely immobilize said support rod, and an adjustment configuration where the support rod is allowed to adjustably rotate with respect to the sleeve and corresponding base component of the roller frame.

8. The roller frame according to claim 7, wherein the roller frame comprises a rubberized tube being provided about a portion of the support rod contained within the sleeve of the base component for assisting in a frictional engagement between the sleeve and corresponding support rod when the latter is selectively secured by the tightening assembly; and wherein the rubberized tube comprises a main hole being complementary to a main hole of the support rod, and through which an adjustment component of the tightening assembly is passable.

9. The roller frame according to claim 7, wherein the base component is substantially T-shaped, and wherein the sleeve extends along a top portion of the base component.

10. The roller frame according to claim 9, wherein a bottom portion of the base component is provided with an inner cavity being positioned, shaped and sized to cooperate with a complementary tool to be used with the roller frame; and wherein the inner cavity of the base component is threaded for threadedly receiving a corresponding extension pole.

11. The roller frame according to claim 7, wherein the support rod comprises a main hole for receiving a corresponding adjustment component of the tightening assembly; and wherein the adjustment component is positioned, shaped and sized for extending through the base component of the roller frame.

12. The roller frame according to claim 11, wherein the adjustment component is threaded and is configured for cooperating with a corresponding threaded tightening knob, in order to selectively urge first and second clamping portions of the base component towards one another, in order to in turn selectively maintain the support rod and corresponding supporting components of the roller frame at a fixed operating angle.

13. The roller frame according to claim 12, wherein the tightening knob is provided with at least one tightening lever; wherein the tightening knob is provided with three tightening levers; and wherein the tightening levers are spaced angularly equidistantly from one another about the tightening knob.

14. The roller frame according to claim 11, wherein the adjustment component is positioned, shaped and sized for extending along at least one slot defined about the base component; and wherein the roller frame comprises complementary front and rear slots being provided respectively about front and rear sides of the base component.

15. The roller frame according to claim 14, wherein each slot is provided with different surface segments corresponding to different positions of the adjustment component, thereby in turn causing the first and second supporting components of the roller frame to rotate with respect to the base component via the tightening assembly, for allowing the roller frame to be selectively positioned at different incremental angles with respect to the base component.

16. The roller frame according to claim 15, wherein the different surface segments of each slot are positioned, shaped and sized so as to allow the first and second supporting components to rotate with respect to the base component along angle increments, the angle increments being selected from the group consisting of 5, 10, 15, 20, 25, 30, 35, 40, 45 and 90 degrees.

17. The roller frame according to claim 16, wherein the different surface segments of each slot are positioned, shaped and sized so as to allow the first and second supporting components of the roller frame to rotate with respect to the base component between two different major angle configurations; wherein a first major angle configuration is about 0 degrees with respect to a longitudinal axis of the base component, and wherein a second major angle configuration is about 30 degrees with respect to the longitudinal axis of the base component.

18. The roller frame according to claim 17, wherein each slot is provided within a corresponding recessed portion defined about the base component, the recessed portion comprising a corresponding peripheral wall for guiding movement of a corresponding component of the tightening assembly.

* * * * *